US009316972B2

(12) United States Patent
Arai et al.

(10) Patent No.: US 9,316,972 B2
(45) Date of Patent: Apr. 19, 2016

(54) FIXING DEVICE AND IMAGE FORMING APPARATUS INCORPORATING SAME

(71) Applicants: Yuji Arai, Kanagawa (JP); Masaaki Yoshikawa, Tokyo (JP); Kenji Ishii, Kanagawa (JP); Tadashi Ogawa, Tokyo (JP); Teppei Kawata, Kanagawa (JP); Arinobu Yoshiura, Kanagawa (JP); Toshihiko Shimokawa, Kanagawa (JP); Kensuke Yamaji, Kanagawa (JP); Yoshiki Yamaguchi, Kanagawa (JP); Hiromasa Takagi, Tokyo (JP); Naoki Iwaya, Tokyo (JP); Takahiro Imada, Kanagawa (JP); Hajime Gotoh, Kanagawa (JP); Akira Suzuki, Tokyo (JP)

(72) Inventors: Yuji Arai, Kanagawa (JP); Masaaki Yoshikawa, Tokyo (JP); Kenji Ishii, Kanagawa (JP); Tadashi Ogawa, Tokyo (JP); Teppei Kawata, Kanagawa (JP); Arinobu Yoshiura, Kanagawa (JP); Toshihiko Shimokawa, Kanagawa (JP); Kensuke Yamaji, Kanagawa (JP); Yoshiki Yamaguchi, Kanagawa (JP); Hiromasa Takagi, Tokyo (JP); Naoki Iwaya, Tokyo (JP); Takahiro Imada, Kanagawa (JP); Hajime Gotoh, Kanagawa (JP); Akira Suzuki, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 13/929,920

(22) Filed: Jun. 28, 2013

(65) Prior Publication Data

US 2014/0016971 A1 Jan. 16, 2014

(30) Foreign Application Priority Data

Jul. 12, 2012 (JP) ..... 2012-156682
Mar. 26, 2013 (JP) ..... 2013-064455

(51) Int. Cl.
*G03G 15/20* (2006.01)

(52) U.S. Cl.
CPC ..... *G03G 15/2053* (2013.01); *G03G 15/2064* (2013.01); *G03G 15/2089* (2013.01); *G03G 2215/2016* (2013.01); *G03G 2215/2032* (2013.01); *G03G 2215/2035* (2013.01)

(58) Field of Classification Search
CPC ..... G03G 15/20
USPC ..... 399/329
See application file for complete search history.

(56) References Cited

U.S. PATENT DOCUMENTS

| | | | | |
|---|---|---|---|---|
| 7,359,666 | B2 * | 4/2008 | Takashi et al. | 399/329 |
| 8,588,670 | B2 * | 11/2013 | Shimokawa et al. | 399/334 |
| 2007/0292175 | A1 | 12/2007 | Shinshi | |

(Continued)

FOREIGN PATENT DOCUMENTS

| | | |
|---|---|---|
| JP | 4-044075 | 2/1992 |
| JP | 8-262903 | 10/1996 |

(Continued)

*Primary Examiner* — Clayton E Laballe
*Assistant Examiner* — Kevin Butler
(74) *Attorney, Agent, or Firm* — Harness, Dickey & Pierce, P.L.C.

(57) ABSTRACT

A fixing device includes a fixing rotary body rotatable in a given direction of rotation and a pressing rotary body pressed against the fixing rotary body to form a fixing nip therebetween through which a recording medium bearing a toner image is conveyed. A heater is disposed inside the fixing rotary body to heat the fixing rotary body. A reflector, disposed opposite an inner circumferential surface of the fixing rotary body via the heater, reflects light emitted from the heater onto the fixing rotary body. The reflector includes a movable portion movable relative to the heater to direct the light emitted from the heater onto a variable heating span of the fixing rotary body spanning in an axial direction thereof. The variable heating span varies depending on a width of the recording medium in the axial direction of the fixing rotary body.

19 Claims, 16 Drawing Sheets

(56) References Cited

U.S. PATENT DOCUMENTS

| | | | | |
|---|---|---|---|---|
| 2010/0092220 | A1 | 4/2010 | Hasegawa et al. | |
| 2010/0232822 | A1 | 9/2010 | Takenaka et al. | |
| 2010/0290822 | A1 | 11/2010 | Hasegawa et al. | |
| 2011/0058864 | A1* | 3/2011 | Fujimoto et al. | 399/329 |
| 2011/0058866 | A1* | 3/2011 | Ishii et al. | 399/331 |
| 2011/0064437 | A1* | 3/2011 | Yamashina et al. | 399/67 |
| 2011/0064443 | A1* | 3/2011 | Iwaya et al. | 399/69 |
| 2011/0070003 | A1* | 3/2011 | Shinshi | 399/329 |
| 2011/0076071 | A1* | 3/2011 | Yamaguchi et al. | 399/329 |
| 2011/0217095 | A1* | 9/2011 | Ishii et al. | 399/329 |
| 2011/0274453 | A1 | 11/2011 | Shimokawa et al. | |
| 2013/0189008 | A1* | 7/2013 | Ishii et al. | 399/329 |
| 2013/0195523 | A1* | 8/2013 | Yamaji et al. | 399/329 |
| 2013/0195524 | A1* | 8/2013 | Ishii et al. | 399/329 |
| 2013/0251422 | A1* | 9/2013 | Iwaya et al. | 399/329 |
| 2013/0266355 | A1* | 10/2013 | Yoshiura et al. | 399/329 |
| 2014/0016971 | A1* | 1/2014 | Arai et al. | 399/329 |
| 2014/0016972 | A1* | 1/2014 | Seshita et al. | 399/329 |
| 2015/0110532 | A1* | 4/2015 | Takeuchi | 399/329 |

FOREIGN PATENT DOCUMENTS

| | | | | |
|---|---|---|---|---|
| JP | 10-213984 | | 8/1998 | |
| JP | 2007-334205 | | 12/2007 | |
| JP | 2009-237089 | | 10/2009 | |
| JP | 2010-096782 | | 4/2010 | |
| JP | 2010-113200 | | 5/2010 | |
| JP | 2010-217257 | | 9/2010 | |
| JP | 2010-286815 | | 12/2010 | |
| JP | 2011-059365 | | 3/2011 | |
| JP | 2011-237495 | | 11/2011 | |
| JP | 2012-063463 | * | 3/2012 | G03G 15/20 |
| JP | 2012-123313 | | 6/2012 | |
| JP | 2012-128331 | | 7/2012 | |
| JP | 2012-128332 | | 7/2012 | |

* cited by examiner

FIXING DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application Nos. 2012-156682, filed on Jul. 12, 2012, and 2013-064455, filed on Mar. 26, 2013, in the Japanese Patent Office, the entire disclosure of each of which is hereby incorporated by reference herein.

BACKGROUND

1. Field

Example embodiments generally relate to a fixing device and an image forming apparatus, and more particularly, to a fixing device for fixing a toner image on a recording medium and an image forming apparatus incorporating the fixing device.

2. Discussion of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

FIG. 1 illustrates one example of such fixing device. As shown in FIG. 1, a fixing device 100R includes a fixing belt 101R looped across a heating roller 111R accommodating a heater 110R and a fixing roller 113R including an elastic layer 112R. A pressing roller 102R is pressed against the heating roller 113R via the fixing belt 101R to form a fixing nip 114R between the pressing roller 102R and the fixing belt 101R. As a recording medium 120R bearing a toner image is conveyed through the fixing nip 114R, the fixing belt 101R heated by the heater 110R through the heating roller 111R and the pressing roller 102R apply heat and pressure to the recording medium 120R, thus fixing the toner image on the recording medium 120R.

In order to heat the fixing belt quickly, the fixing belt may be formed into a circular loop and receive light directly from a heater and indirectly through a reflector. FIG. 2 illustrates a fixing device 200R incorporating such reflector. As shown in FIG. 2, a tubular thermal conductor 202R is disposed opposite an inner circumferential surface of a fixing belt 204R. A heater 201R is interposed between the thermal conductor 202R and a reflector 203R. The thermal conductor 202R receives light from the heater 201R shown in the solid line that irradiates the thermal conductor 202R directly and light from the heater 201R shown in the dotted line that is reflected by the reflector 203R onto the thermal conductor 202R. Thus, the thermal conductor 202R, heated by the light from the heater 201R that irradiates the thermal conductor 202R directly and the light from the heater 201R that irradiates the thermal conductor 202R indirectly through the reflector 203R, in turn heats the fixing belt 204R. Accordingly, the fixing belt 204R is heated quickly.

However, since the reflector 203R is a single planar plate, it reflects light emitted from an invariable heating span L of the heater 201R onto the invariable heating span L of the thermal conductor 202R in an axial direction of the fixing belt 204R. Accordingly, if recording media of various sizes are conveyed through the fixing device 200R, the invariable heating span L of the thermal conductor 202R may not be equivalent to the width of recording media of various sizes and therefore the recording media may be heated unevenly in a width direction thereof parallel to the axial direction of the fixing belt 204R, resulting fixing failure.

For example, as shown in FIG. 2, as a recording medium P1 having a width W1 is conveyed through the fixing device 200R, since the width W1 of the recording medium P1 is equivalent to the invariable heating span L of the thermal conductor 202R and the fixing belt 204R, the recording medium P1 is heated evenly throughout the width W1 thereof as shown in the line indicating the temperature of the fixing belt 204R.

Conversely, as a recording medium P2 having a width W2 is conveyed through the fixing device 200R, since the width W2 of the recording medium P2 is greater than the invariable heating span L of the thermal conductor 202R and the fixing belt 204R, both lateral ends of the recording medium P2 outboard from the invariable heating span L in a width direction of the recording medium P2 may be heated insufficiently, resulting fixing failure.

Additionally, as shown in FIG. 3, as a recording medium P3 having a width W3 is conveyed through the fixing device 200R, since the width W3 of the recording medium P3 is smaller than the invariable heating span L of the thermal conductor 202R and the fixing belt 204R, both lateral ends of the fixing belt 204R outboard from the width W3 of the recording medium P3 in a width direction thereof may be overheated because the recording medium P3 is not conveyed over both lateral ends of the fixing belt 204R and therefore does not draw heat from the fixing belt 204R. Accordingly, the fixing belt 204R may be subject to thermal damage and breakage.

SUMMARY

At least one embodiment may provide a fixing device that includes a fixing rotary body rotatable in a given direction of rotation and a pressing rotary body pressed against the fixing rotary body to form a fixing nip therebetween through which a recording medium bearing a toner image is conveyed. A heater is disposed inside the fixing rotary body to heat the fixing rotary body. A reflector, disposed opposite an inner circumferential surface of the fixing rotary body via the heater, reflects light emitted from the heater onto the fixing rotary body. The reflector includes a movable portion movable relative to the heater to direct the light emitted from the heater onto a variable heating span of the fixing rotary body spanning in an axial direction thereof. The variable heating span varies depending on a width of the recording medium in the axial direction of the fixing rotary body.

At least one embodiment may provide an image forming apparatus that includes the fixing device described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
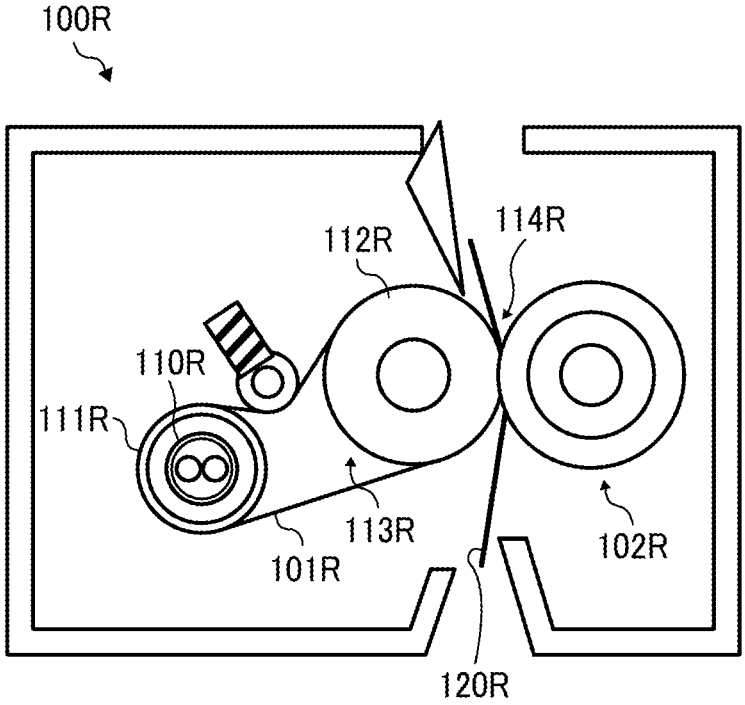
FIG. 1 RELATED ART
FIG. 1 is a vertical sectional view of a related-art fixing device.
Figure 2:
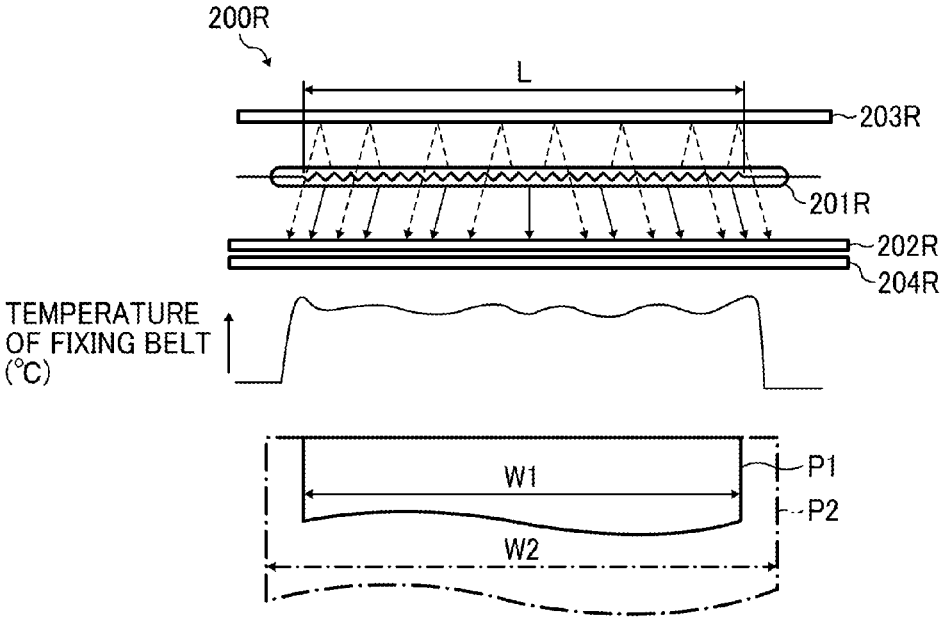
FIG. 2 RELATED ART
FIG. 2 is a schematic sectional view of another related-art fixing device illustrating a temperature distribution of a fixing belt incorporated therein as a large recording medium is conveyed.
Figure 3:
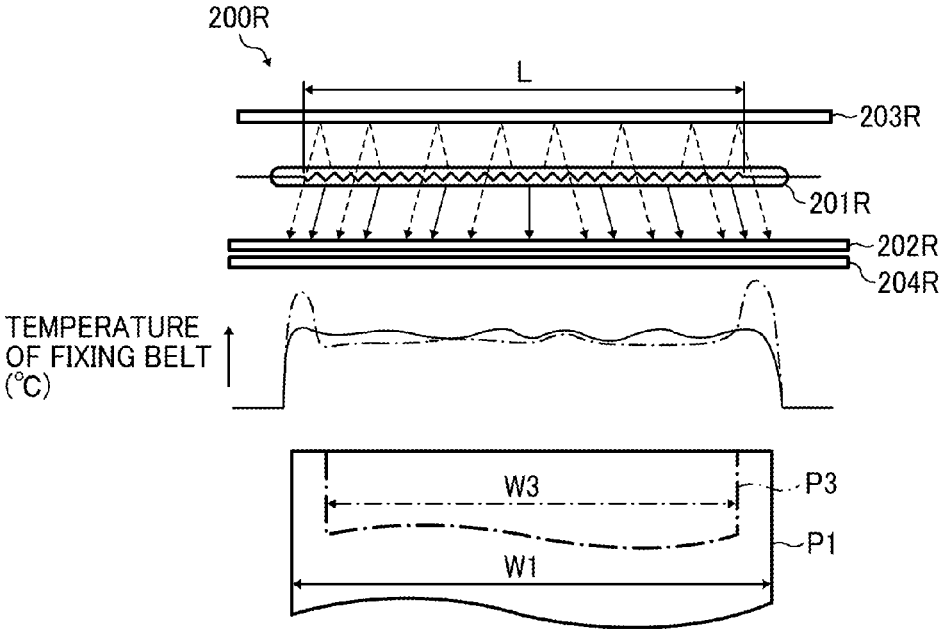
FIG. 3 RELATED ART
FIG. 3 is a schematic sectional view of the related-art fixing device shown in FIG. 2 illustrating a temperature distribution of the fixing belt as a small recording medium is conveyed.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 4:
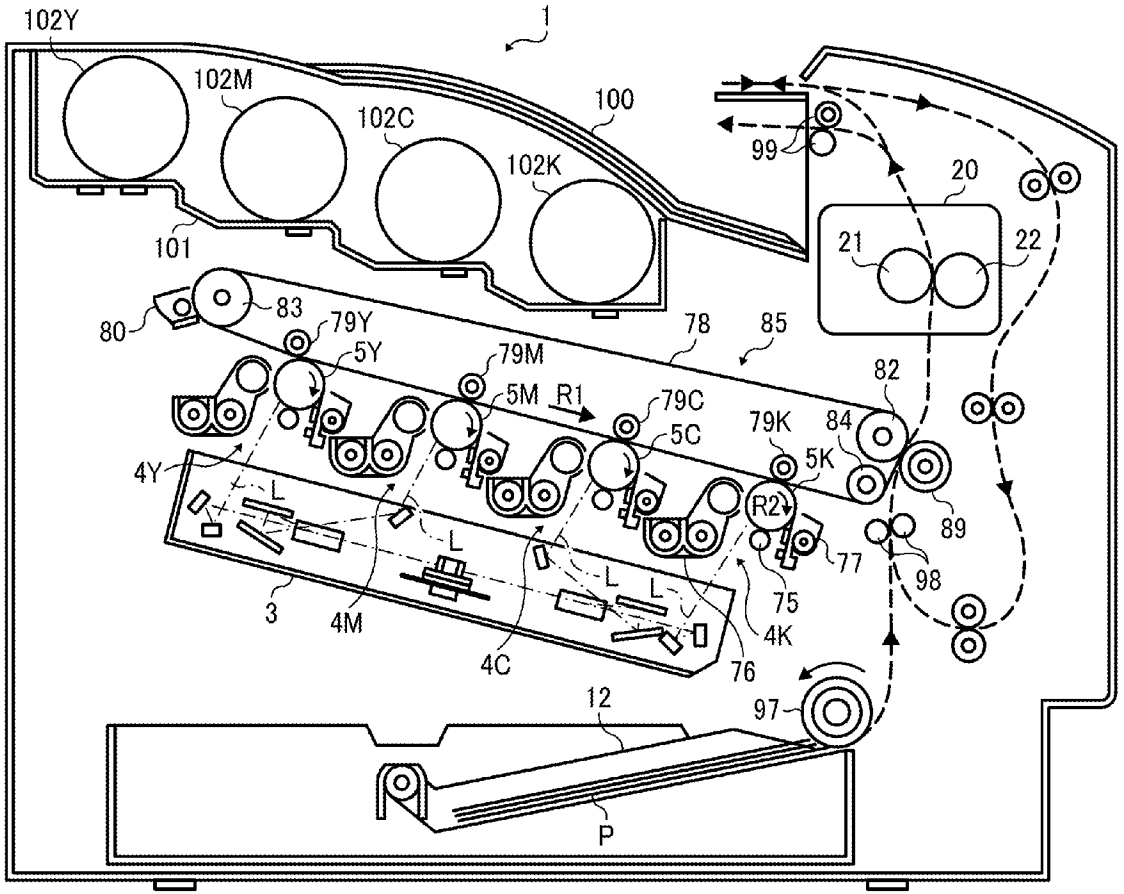
FIG. 4 is a schematic vertical sectional view of an image forming apparatus according to an example embodiment of the present invention.

Referring now to the drawings, wherein like reference numerals designate identical or corresponding parts throughout the several views, particularly to FIG. 4, an image forming apparatus 1 according to an example embodiment is explained.

FIG. 4 is a schematic vertical sectional view of the image forming apparatus 1. The image forming apparatus 1 may be a copier, a facsimile machine, a printer, a multifunction peripheral (MFP) having at least one of copying, printing, scanning, facsimile, and plotter functions, or the like. According to this example embodiment, the image forming apparatus 1 is a tandem color printer that forms color and monochrome toner images on recording media by electrophotography.

Four toner bottles 102Y, 102M, 102C, and 102K containing fresh yellow, magenta, cyan, and black toners are detachably attached to a bottle holder 101 located in an upper portion of the image forming apparatus 1 so that a user replaces the toner bottles 102Y, 102M, 102C, and 102K with new ones, respectively.

Below the bottle holder 101 is an intermediate transfer unit 85 including an intermediate transfer belt 78 rotatable in a rotation direction R1. The intermediate transfer belt 78 is disposed opposite four image forming devices 4Y, 4M, 4C, and 4K, aligned along the rotation direction R1 of the intermediate transfer belt 78, that form yellow, magenta, cyan, and black toner images, respectively.

The image forming devices 4Y, 4M, 4C, and 4K include photoconductive drums 5Y, 5M, 5C, and 5K, respectively. Each of the photoconductive drums 5Y, 5M, 5C, and 5K is surrounded by a charger 75, a development device 76, a cleaner 77, and a discharger, respectively. The image forming devices 4Y, 4M, 4C, and 4K perform image forming processes including a charging process, an exposure process, a development process, a primary transfer process, and a cleaning process on the photoconductive drums 5Y, 5M, 5C, and 5K as the photoconductive drums 5Y, 5M, 5C, and 5K rotate clockwise in FIG. 1 in a rotation direction R2, thus forming yellow, magenta, cyan, and black toner images on the photoconductive drums 5Y, 5M, 5C, and 5K.

A detailed description is now given of the image forming processes performed on the photoconductive drums 5Y, 5M, 5C, and 5K.

A driver (e.g., a motor) drives and rotates the photoconductive drums 5Y, 5M, 5C, and 5K clockwise in FIG. 1 in the rotation direction R2. The charger 75 uniformly charges an outer circumferential surface of the respective photoconductive drums 5Y, 5M, 5C, and 5K in the charging process. In the exposure process, an exposure device 3 emits laser beams onto the charged outer circumferential surface of the respective photoconductive drums 5Y, 5M, 5C, and 5K, forming electrostatic latent images thereon according to yellow, magenta, cyan, and black image data constituting color image data sent from an external device such as a client computer.

In the development process, the development device 76 visualizes the electrostatic latent image formed on the respective photoconductive drums 5Y, 5M, 5C, and 5K with yellow, magenta, cyan, and black toners supplied from the toner bottles 102Y, 102M, 102C, and 102K into yellow, magenta, cyan, and black toner images, respectively. The photoconductive drums 5Y, 5M, 5C, and 5K are disposed opposite primary transfer bias rollers 79Y, 79M, 79C, and 79K via the intermediate transfer belt 78 to form primary transfer nips between the intermediate transfer belt 78 and the photoconductive drums 5Y, 5M, 5C, and 5K, respectively. In the primary transfer process, the primary transfer bias rollers 79Y, 79M, 79C, and 79K primarily transfer the yellow, magenta, cyan, and black toner images formed on the photoconductive drums 5Y, 5M, 5C, and 5K onto the intermediate transfer belt 78. After the primary transfer process, a slight amount of residual toner failed to be transferred onto the intermediate transfer belt 78 remains on the photoconductive drums 5Y, 5M, 5C, and 5K.

To address this circumstance, in the cleaning process, a cleaning blade of the respective cleaners 77 mechanically collects the residual toner from the photoconductive drums 5Y, 5M, 5C, and 5K.

Finally, the discharger disposed opposite the respective photoconductive drums 5Y, 5M, 5C, and 5K removes residual potential from the photoconductive drums 5Y, 5M, 5C, and 5K. Thus, a series of image forming processes performed on the photoconductive drums 5Y, 5M, 5C, and 5K is completed.

The yellow, magenta, cyan, and black toner images primarily transferred from the photoconductive drums 5Y, 5M, 5C, and 5K onto the intermediate transfer belt 78 are superimposed on a same position on the intermediate transfer belt 78. Thus, a color toner image is formed on the intermediate transfer belt 78.

A detailed description is now given of a construction of the intermediate transfer unit 85.

The intermediate transfer unit 85 includes the intermediate transfer belt 78, the four primary transfer bias rollers 79Y, 79M, 79C, and 79K, a secondary transfer backup roller 82, a cleaning backup roller 83, a tension roller 84, and an intermediate transfer belt cleaner 80. The intermediate transfer belt 78 is stretched across and supported by the three rollers, that is, the secondary transfer backup roller 82, the cleaning backup roller 83, and the tension roller 84. As the secondary transfer backup roller 82 is driven and rotated by a driver (e.g., a motor), the secondary transfer backup roller 82 drives and rotates the intermediate transfer belt 78 counterclockwise in FIG. 1 in the rotation direction R1 by friction therebetween.

The four primary transfer bias rollers 79Y, 79M, 79C, and 79K and the photoconductive drums 5Y, 5M, 5C, and 5K sandwich the intermediate transfer belt 78 to form the primary transfer nips between the photoconductive drums 5Y, 5M, 5C, and 5K and the intermediate transfer belt 78. A transfer bias having a polarity opposite a polarity of toner is applied to the primary transfer bias rollers 79Y, 79M, 79C, and 79K. As the intermediate transfer belt 78 rotates in the rotation direction R1, the yellow, magenta, cyan, and black toner images formed on the photoconductive drums 5Y, 5M, 5C, and 5K are primarily transferred successively onto the intermediate transfer belt 78 such that the yellow, magenta, cyan, and black toner images are superimposed on the same position on the intermediate transfer belt 78. Thus, a color toner image is formed on the intermediate transfer belt 78.

A detailed description is now given of a secondary transfer process performed on the intermediate transfer belt 78.

The secondary transfer backup roller 82 is disposed opposite a secondary transfer roller 89 via the intermediate transfer belt 78 to form a secondary transfer nip between the intermediate transfer belt 78 and the secondary transfer roller 89. As the color toner image formed on the intermediate transfer belt 78 travels through the secondary transfer nip, the secondary transfer roller 89 secondarily transfers the color toner image formed on the intermediate transfer belt 78 onto a recording medium P conveyed through the secondary transfer nip in the secondary transfer process. After the secondary transfer process, residual toner failed to be transferred onto the recording medium P remains on the intermediate transfer belt 78. To address this circumstance, the intermediate transfer belt cleaner 80 disposed opposite the cleaning backup roller 83 via the intermediate transfer belt 78 removes the residual toner from the intermediate transfer belt 78. Thus, the secondary transfer process performed on the intermediate transfer belt 78 is completed.

A detailed description is now given of conveyance of the recording medium P.

The recording medium P is conveyed from a paper tray 12 located in a lower portion of the image forming apparatus 1 to the secondary transfer nip through a feed roller 97 and a registration roller pair 98. For example, the paper tray 12 loads a plurality of layered recording media P (e.g., transfer sheets). As the feed roller 97 is driven and rotated counterclockwise in FIG. 1, an uppermost recording medium P is conveyed to a roller nip formed between two rollers of the registration roller pair 98.

As the recording medium P comes into contact with the registration roller pair 98, the registration roller pair 98 that stops its rotation halts the recording medium P temporarily. At a time when the color toner image formed on the intermediate transfer belt 78 reaches the secondary transfer nip, the registration roller pair 98 resumes its rotation to feed the recording medium P to the secondary transfer nip. As the recording medium P travels through the secondary transfer nip, the color toner image formed on the intermediate transfer belt 78 is secondarily transferred onto the recording medium P.

Thereafter, the recording medium P bearing the color toner image is conveyed to a fixing device 20. As the recording medium P is conveyed between a fixing belt 21 and a pressing roller 22 of the fixing device 20, the fixing belt 21 and the pressing roller 22 apply heat and pressure to the recording medium P, fixing the color toner image on the recording medium P. After the recording medium P bearing the fixed color toner image is discharged from the fixing device 20, the recording medium P is discharged to an outside of the image forming apparatus 1 through an output roller pair 99. The recording medium P discharged by the output roller pair 99 is stacked on an output tray 100 disposed atop the image forming apparatus 1. Thus, a series of image forming processes performed by the image forming apparatus 1 is completed.

Figure 5A:
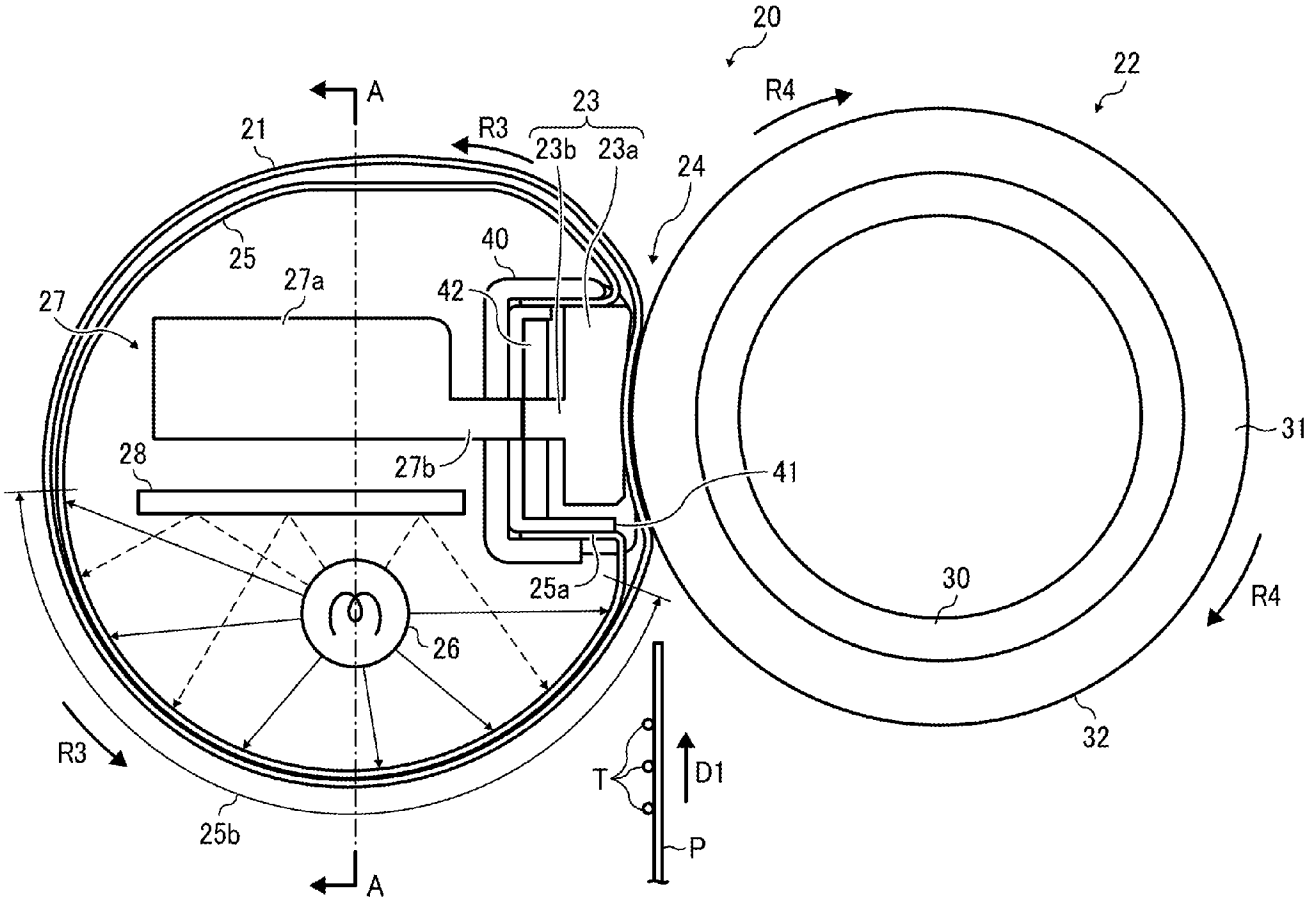
FIG. 5A is a vertical sectional view of a fixing device according to a first example embodiment of the present invention that is installed in the image forming apparatus shown in FIG. 4.
Figure 6A:
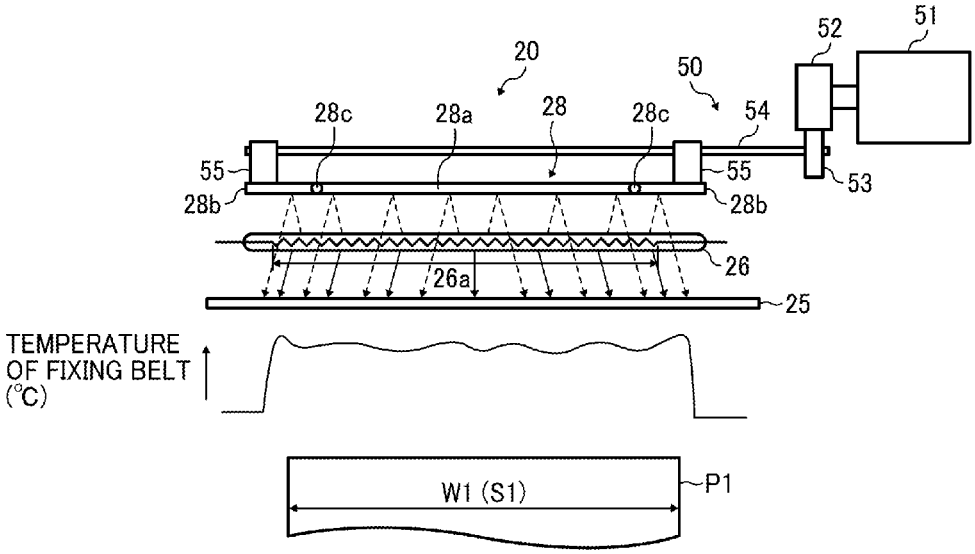
FIG. 6A is a schematic sectional view of the fixing device shown in FIG. 5A illustrating lateral end plates of a reflector incorporated therein at a parallel position.

With reference to FIGS. 5A and 6A, a description is provided of a construction of the fixing device 20 incorporated in the image forming apparatus 1 described above.

FIG. 5A is a vertical sectional view of the fixing device 20 taken on a center in a longitudinal direction thereof. FIG. 6A is a schematic sectional view of the fixing device 20 taken on the line A-A of FIG. 5A.

As shown in FIG. 5A, the fixing device 20 (e.g., a fuser) includes the fixing belt 21 serving as a fixing rotary body or a flexible endless belt formed into a loop and rotatable in a rotation direction R3 and the pressing roller 22 serving as a pressing rotary body disposed opposite an outer circumferential surface of the fixing belt 21 and rotatable in a rotation direction R4 counter to the rotation direction R3 of the fixing belt 21. The pressing roller 22 is pressed against the fixing belt 21. A nip formation pad 23, situated inside the loop formed by the fixing belt 21, presses against the pressing roller 22 via the fixing belt 21 to form a fixing nip 24 between the fixing belt 21 and the pressing roller 22 through which a recording medium P bearing a toner image T is conveyed. A substantially tubular, thermal conductor 25, disposed opposite an inner circumferential surface of the fixing belt 21, rotatably supports the fixing belt 21. A halogen heater 26, disposed inside the loop formed by the fixing belt 21, serves as a heater for heating the thermal conductor 25 which in turn heats the fixing belt 21. A support 27, disposed inside the loop formed by the fixing belt 21, supports the thermal conductor 25 such that the thermal conductor 25 is positioned inside the image forming apparatus 1 depicted in FIG. 1. A reflector 28, disposed inside the loop formed by the fixing belt 21, serves as a reflector for reflecting light radiated from the halogen heater 26 onto the thermal conductor 25.

A detailed description is now given of a construction of the fixing belt 21.

The fixing belt 21 is a tube having an inner loop diameter of about 30 mm and constructed of an iron base layer having a thickness in a range of from about 30 micrometers to about 50 micrometers; a release layer that coats an outer surface of the base layer; and a coating that coats an inner surface of the base layer. Alternatively, instead of iron, the base layer may be made of conductive metal such as cobalt, nickel, stainless steel, and an alloy of these, plastic such as polyimide, or the like.

The release layer facilitates separation of the toner image T on the recording medium P from the fixing belt 21. For example, the release layer is made of tetrafluoroethylene-perfluoroalkyl vinyl ether copolymer (PFA) and having a thickness in a range of from about 10 micrometers to about 50 micrometers. Alternatively, instead of PFA, the release layer may be made of polytetrafluoroethylene (PTFE), polyimide, polyetherimide, polyether sulfide (PES), or the like. The release layer facilitates separation of the toner image T on the recording medium P from the fixing belt 21.

If the release layer coats the base layer directly, as the pressing roller 22 presses the toner image T on the recording medium P against the fixing belt 21, slight surface asperities on the outer circumferential surface of the fixing belt 21 may be transferred onto the toner image T, producing uneven marks on a solid monochrome part of the toner image T that may result in formation of an orange peel image. In order to address this circumstance, an elastic layer (e.g., a silicone rubber layer) may be provided between the base layer and the release layer. For example, the silicone rubber layer having a thickness of about 100 micrometers or more, as it deforms, absorbs slight surface asperities of the fixing belt 21, suppressing formation of an orange peel image. However, the elastic layer is optional. If the fixing belt 21 does not incorporate the elastic layer, the fixing belt 21 has a reduced thermal capacity that facilitates quick warm-up of the fixing belt 21.

The coating of the fixing belt 21 reduces frictional resistance between the fixing belt 21 and the thermal conductor 25. The coating is made of Teflon®. Alternatively, instead of Teflon®, the coating may be a surface coating produced by plating, diamond-like carbon (DLC), glass coating, or the like.

A detailed description is now given of a construction of the pressing roller 22.

The pressing roller 22 is a roller having an outer diameter of about 30 mm. The pressing roller 22 is constructed of a shaft 30 (e.g., a metal pipe), an elastic layer 31 coating the shaft 30 and made of a heat resistant silicone rubber, and a surface release layer 32 coating the elastic layer 31 and made of PFA. The hollow shaft 30 has a thermal capacity smaller than that of a solid shaft. Optionally, a heater (e.g., a halogen heater) may be located inside the hollow shaft 30. According to this example embodiment, the pressing roller 22 is a hollow roller. Alternatively, the pressing roller 22 may be a solid roller.

The elastic layer 31 has a thickness in a range of from about 2 mm to about 3 mm. The silicone rubber of the elastic layer 31 is heat resistant solid rubber. Alternatively, if no heater is situated inside the pressing roller 22, the elastic layer 31 may be made of sponge rubber. The sponge rubber enhances insulation of the pressing roller 22, preventing the pressing roller 22 from drawing heat from the fixing belt 21. The release layer 32 is a PFA tube having a thickness of about 50 micrometers and coating the elastic layer 31. Alternatively, instead of PFA, the release layer 32 may be made of PTFE.

A pressurization assembly presses the pressing roller 22 against the nip formation pad 23 via the fixing belt 21. As the pressing roller 22 is pressed against the nip formation pad 23 via the fixing belt 21, the elastic layer 31 of the pressing roller 22 is deformed by pressure, producing the fixing nip 24 having a given nip length in a recording medium conveyance direction D1. A driver drives and rotates the pressing roller 22 pressed against the fixing belt 21 in the rotation direction R4. Accordingly, the fixing belt 21 rotates in the rotation direction R3 by friction between the fixing belt 21 and the pressing roller 22. Thus, as the recording medium P is conveyed through the fixing nip 24, the recording medium P is pressed against the fixing belt 21 by the pressing roller 22.

The pressing roller 22 includes a grip portion at each lateral end in an axial direction thereof where the recording medium P is not conveyed. The grip portion is an exposed part of the elastic layer 31 not coated by the release layer 32. The grip portion forms a high frictional, outer circumferential surface of the pressing roller 22 that facilitates rotation of the fixing belt 21 by friction between the fixing belt 21 and the pressing roller 22. Alternatively, the pressing roller 22 may include no grip portion and therefore the release layer 32 may extend throughout the entire width of the pressing roller 22 in the axial direction thereof.

A detailed description is now given of a construction of the thermal conductor 25.

The thermal conductor 25 is a substantially C-shaped iron pipe in cross-section having a thickness in a range of from about 0.1 mm to about 1.0 mm. The thermal conductor 25 includes a nip portion 25*a* (e.g., a substantial recess) disposed opposite the fixing nip 24 to hold the nip formation pad 23 and a thermal conducting portion 25*b* disposed upstream from the nip portion 25*a* in the rotation direction R3 of the fixing belt 21 and spanning substantially throughout a lower half of the fixing belt 21 in the rotation direction R3 thereof. The thermal conductor 25 is manufactured by press molding.

Figure 5B:
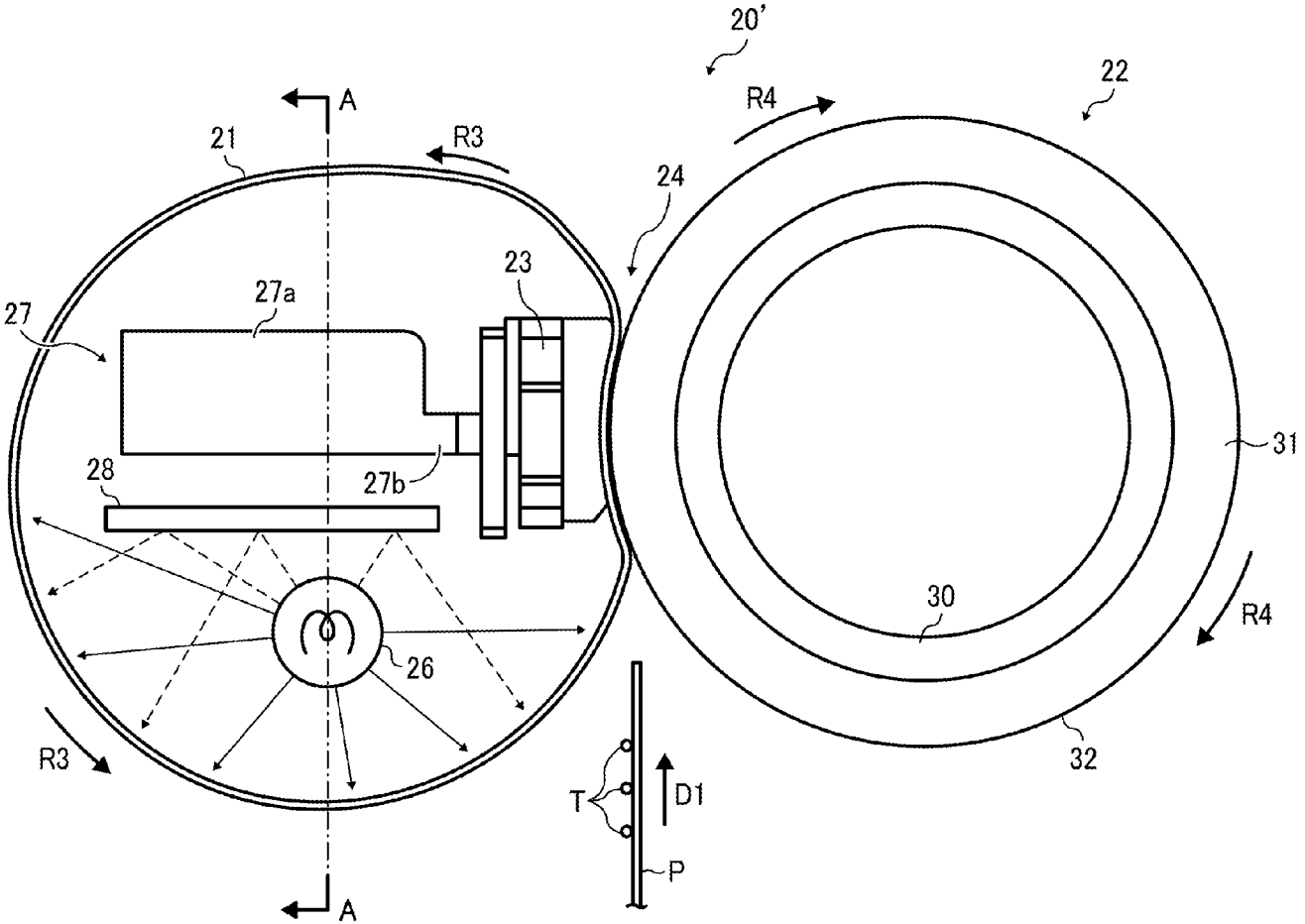
FIG. 5B is a vertical sectional view of a fixing device not incorporating a thermal conductor as a variation of the fixing device shown in FIG. 5A.

According to this example embodiment, the fixing device 20 incorporates the thermal conductor 25. Alternatively, the fixing device 20 may not incorporate the thermal conductor 25 as shown in FIG. 5B. FIG. 5B is a vertical sectional view of a fixing device 20' not incorporating the thermal conductor 25. In this case, the fixing belt 21 may have a thickness or a rigidity great enough to retain the desired shape of the fixing belt 21. Additionally, a flange attached to each lateral end of the fixing belt 21 in an axial direction thereof may include a guide that retains the desired cross-sectional shape of the fixing belt 21.

The thermal conducting portion 25*b* is an arc disposed upstream from and contiguous to the nip portion 25*a* in the rotation direction R3 of the fixing belt 21. The thermal conducting portion 25*b* is heated directly by the halogen heater 26 and partially heated indirectly by light reflected by the reflector 28. Since the fixing belt 21 is pulled in the recording medium conveyance direction Di by the pressing roller 22 rotating in the rotation direction R4, the fixing belt 21 is brought into contact with the thermal conducting portion 25*b* of the thermal conductor 25. An inner circumferential surface of the thermal conductor 25, especially at the thermal conducting portion 25*b*, is treated with black coating to enhance radiation rate of radiation heat from the halogen heater 26.

An outer circumferential surface of the thermal conductor 25 is treated with a coating such as Teflon® to reduce frictional resistance between the fixing belt 21 and the thermal conductor 25. Alternatively, instead of Teflon®, the coating may be a surface coating produced by plating, DLC, glass coating, or the like. Grease is applied between the fixing belt 21 and the thermal conductor 25 to reduce frictional resistance therebetween.

The nip portion 25*a* is attached with a substantially U-shaped outer bracket 40 in cross-section and a substantially U-shaped inner bracket 41 in cross-section. The outer bracket 40 contacts an outer face of the nip portion 25*a* and faces the inner circumferential surface of the thermal conductor 25. Conversely, the inner bracket 41 contacts an inner face of the nip portion 25*a* and the outer circumferential surface of the thermal conductor 25. The outer bracket 40 and the inner bracket 41 sandwich walls of the nip portion 25*a*. For example, the outer bracket 40 and the inner bracket 41 are fastened to the walls of the nip portion 25*a* with screws. Thus, the outer bracket 40 and the inner bracket 41 attached to the nip portion 25*a* retain the desired shape of the nip portion 25*a*. Each lateral end of the outer bracket 40 in a longitudinal direction thereof parallel to the axial direction of the fixing belt 21 is mounted on the flange mounting each lateral end of the thermal conductor 25 in a longitudinal direction thereof parallel to the axial direction of the fixing belt 21. Thus, the outer bracket 40 is fixedly attached to the thermal conductor 25.

A detailed description is now given of a construction of the nip formation pad 23. The nip formation pad 23 is situated inside the inner bracket 41. The nip formation pad 23 is a substantially prismatic rod extending along the longitudinal direction of the thermal conductor 25 and made of heat resistant plastic. The nip formation pad 23 includes a body 23*a* disposed opposite the pressing roller 22 via the fixing belt 21 and a projection 23*b* projecting from a back face of the body 23*a* and contacting the support 27 that supports the nip formation pad 23. The nip formation pad 23 further includes a slide sheet covering a front face of the body 23*a* and contacting the inner circumferential surface of the fixing belt 21. Alternatively, the nip formation pad 23 may not incorporate the slide sheet.

The front face of the body 23*a* facing the pressing roller 22 via the fixing belt 21 forms a curve (e.g., a recess) corresponding to a curve of the outer circumferential surface of the pressing roller 22. The curve of the front face of the body 23*a* directs the recording medium P discharged from the fixing nip 24 to the pressing roller 22, facilitating separation of the recording medium P from the fixing belt 21 and thereby suppressing jamming of the recording medium P. According to this example embodiment, the nip formation pad 23 has the recess facing the pressing roller 22 to produce the curved fixing nip 24. Alternatively, the nip formation pad 23 may have other shapes, for example, a plane facing the pressing roller 22 to produce a planar fixing nip. The projection 23*b* is supported by a nip formation pad holder 42 mounted on the inner bracket 41.

The slide sheet is film made of fabric such as PTFE fiber that reduces frictional resistance between the fixing belt 21 and the nip formation pad 23. The nip formation pad 23 is mounted on the flange mounting each lateral end of the thermal conductor 25 in the longitudinal direction thereof. Thus, the nip formation pad 23 is fixedly attached to the thermal conductor 25. Even if the pressing roller 22 presses the fixing belt 21 against the body 23*a* of the nip formation pad 23, the projection 23*b* contacted and supported by the support 27 prevents the body 23*a* from being moved inward by pressure from the pressing roller 22.

The support 27 is a substantially prismatic, metal rod extending along the longitudinal direction of the thermal conductor 25. The support 27 is constructed of a body 27*a* having an increased rigidity and a projection 27*b* contacting the projection 23*b* of the nip formation pad 23. The support 27 is made of stainless steel, aluminum, or the like. The projection 27*b*, by contacting the projection 23*b* of the nip formation pad 23, supports the nip formation pad 23 against pressure from the pressing roller 22 from the back face of the body 23*a* of the nip formation pad 23. The support 27 is mounted on the flange mounting each lateral end of the thermal conductor 25 in the longitudinal direction thereof. Thus, the support 27 is fixedly secured to the thermal conductor 25.

A detailed description is now given of a configuration of the halogen heater 26.

The halogen heater 26 extends throughout a long length of the fixing belt 21 in the axial direction thereof and heats by radiation heat the thermal conducting portion 25*b* spanning over at least a part of the thermal conductor 25 in the rotation direction R3 of the fixing belt 21 so that the thermal conductor 25 heats the fixing belt 21 by conducting heat from the thermal conducting portion 25*b* to the fixing belt 21. The halogen heater 26 is a linear heat generator situated inside the thermal conductor 25 and extending in the longitudinal direction of the thermal conductor 25. According to this example embodiment, the halogen heater 26 serves as a heater that heats the fixing belt 21 through the thermal conductor 25. Alternatively, other linear or sheet heat generator may serve as a heater.

The halogen heater 26 is disposed opposite the inner circumferential surface of the thermal conductor 25 at the thermal conducting portion 25*b* thereof. Since the thermal conducting portion 25*b* of the thermal conductor 25 faces the halogen heater 26 directly, light radiated from the halogen heater 26 irradiates the thermal conducting portion 25*b* without being blocked by the support 27. As shown in FIG. 6A, the halogen heater 26 has a heating portion 26*a* extending in a longitudinal direction thereof parallel to the axial direction of the fixing belt 21, where the halogen heater 26 radiates heat. The length of the heating portion 26*a* in the longitudinal direction of the halogen heater 26 is determined arbitrarily. However, it is preferable that the length of the heating portion 26*a* is equivalent to the width of recording media frequently used, such as an A3 size (297 mm×420 mm) recording medium in portrait orientation and an A4 size (210 mm×297 mm) recording medium in landscape orientation. A temperature sensor for detecting the temperature of the fixing belt 21 is disposed opposite the heating portion 26*a* of the halogen heater 26.

As shown in FIG. 5A, the reflector 28 is disposed opposite the thermal conducting portion 25*b* of the thermal conductor 25 via the halogen heater 26. The reflector 28 reflects light, that is, radiation heat, radiated from the halogen heater 26 onto the thermal conducting portion 25*b* of the thermal conductor 25, thus heating the thermal conducting portion 25*b* of the thermal conductor 25 and at the same time reducing heat that may be drawn to the body 27*a* of the support 27.

As shown in FIG. 6A, the reflector 28 includes a center plate 28*a*; a lateral end plate 28*b* contiguous to and disposed outboard from the center plate 28*a* at each lateral end of the reflector 28 in the axial direction of the fixing belt 21; and a hinge 28*c* interposed between the center plate 28*a* and the lateral end plate 28*b*. The center plate 28*a* and each lateral end plate 28*b* are constructed of a base made of aluminum and a surface layer disposed opposite the halogen heater 26 and treated with silver-vapor-deposition. Silver having a decreased radiation rate reflects light radiated from the halogen heater 26 and irradiating the reflector 28 effectively, facilitating heat conduction to the fixing belt 21. Alternatively, the reflector 28 may be constructed of materials other than the materials of the aluminum base and the surface layer treated with silver-vapor-deposition.

Figure 6B:
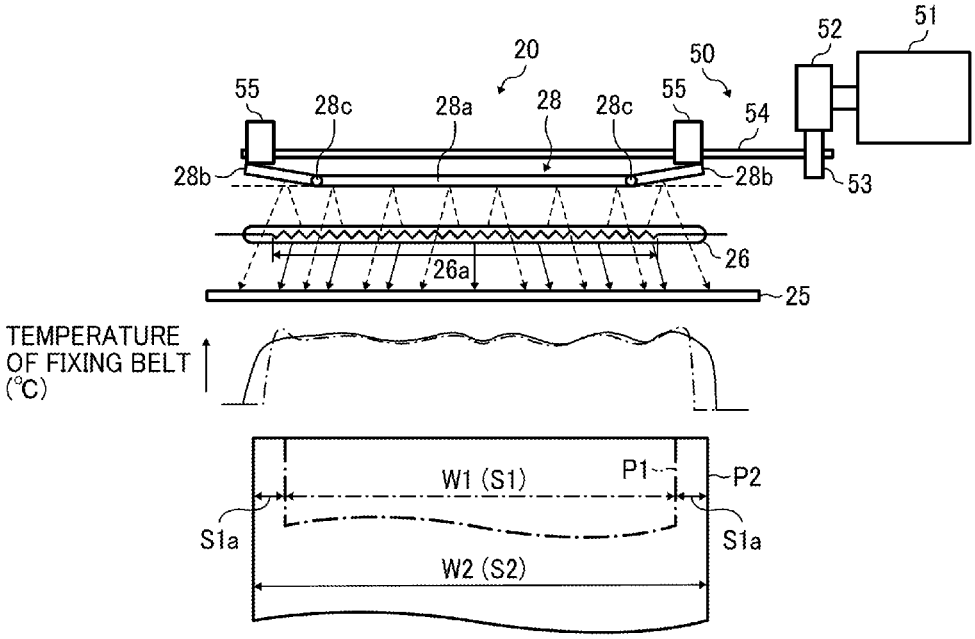
FIG. 6B is a schematic sectional view of the fixing device shown in FIG. 6A illustrating the lateral end plates at a first angled position.

FIG. 6B is a schematic sectional view of the fixing device 20 illustrating each lateral end plate 28*b* angled relative to the center plate 28*a*. As shown in FIG. 6B, the hinge 28*c* supports the lateral end plate 28*b* such that the lateral end plate 28*b* serving as a movable portion is rotatable relative to the center plate 28*a* serving as a stationary portion. The hinge 28*c* incorporates a biasing member that biases the lateral end plate 28*b* in a direction in which the lateral end plate 28*b* is spaced apart farther from the halogen heater 26 with an increased interval therebetween relative to a position where the lateral end plate 28*b* is parallel to the halogen heater 26 as shown in FIG. 6A. That is, the hinge 28*c* angles the lateral end plate 28*b* relative to the halogen heater 26. Thus, each lateral end plate 28*b* of the reflector 28 is movable.

A description is provided of a construction of a driving assembly 50 for driving and rotating the lateral end plates 28*b* of the reflector 28.

As shown in FIG. 6A, the driving assembly 50 is situated in proximity to the reflector 28. The driving assembly 50 includes a driver 51 (e.g., a stepping motor); a pinion gear 52 coupled to the driver 51; a reduction gear 53 engaging the pinion gear 52; a shaft 54 mounting the reduction gear 53 and rotatable with the reduction gear 53; and two cams 55 mounted on the shaft 54. The driver 51 is actuated by a central processing unit (CPU) incorporated in the image forming apparatus 1 depicted in FIG. 4.

Figure 7A:
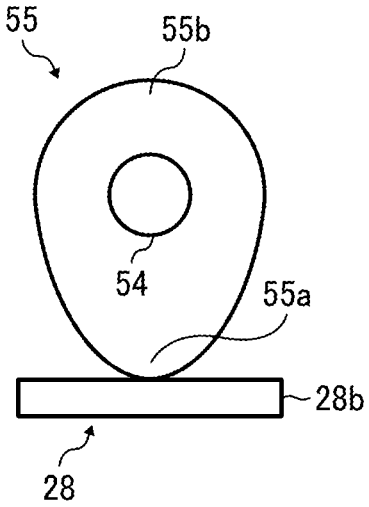
FIG. 7A is a vertical sectional view of a cam and the lateral end plate of the reflector shown in FIG. 6A at the parallel position.
Figure 7B:
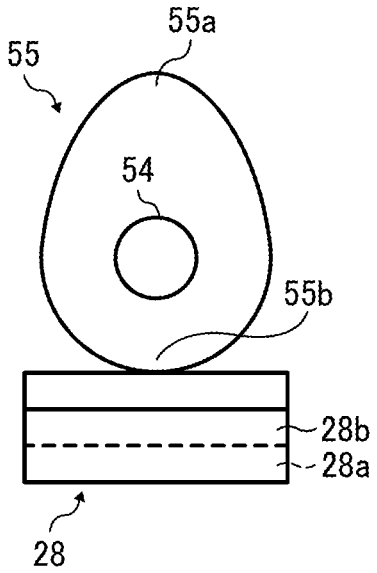
FIG. 7B is a vertical sectional view of the cam and the lateral end plate of the reflector shown in FIG. 6B at the first angled position.

FIG. 7A is a vertical sectional view of the cam 55 and the lateral end plate 28*b* of the reflector 28 parallel to the halogen heater 26. FIG. 7B is a vertical sectional view of the cam 55 and the lateral end plate 28*b* of the reflector 28 angled relative to the halogen heater 26. As shown in FIG. 7A, the cam 55 includes a long diameter portion 55*a* and a short diameter portion 55*b*. As shown in FIGS. 7A and 7B, the cam 55 is in contact with the lateral end plate 28*b* of the reflector 28. As the long diameter portion 55*a* of the cam 55 comes into contact with the lateral end plate 28*b* of the reflector 28 as shown in FIG. 7A, the lateral end plate 28*b* is parallel to the halogen heater 26 at a parallel position shown in FIG. 6A. Conversely, as the short diameter portion 55*b* of the cam 55 comes into contact with the lateral end plate 28*b* of the reflector 28 as shown in FIG. 7B, the lateral end plate 28*b* is angled relative to the halogen heater 26 and spaced apart from the halogen heater 26 with an increased interval therebetween at a first angled position shown in FIG. 6B.

As the driver 51 is actuated and rotated, the driver 51 drives and rotates the shaft 54 and the cams 55 through the pinion gear 52 and the reduction gear 53. As the cams 55 rotate, the cams 55 change the position of both lateral end plates 28*b* of the reflector 28. For example, each cam 55 lowers each lateral end plate 28*b* of the reflector 28 to the parallel position shown in FIG. 6A where each lateral end plate 28*b* is parallel to the halogen heater 26 and lifts each lateral end plate 28*b* of the reflector 28 to the first angled position shown in FIG. 6B where each lateral end plate 28*b* is angled relative to the halogen heater 26 with an increased interval therebetween.

The flange mounting each lateral end of the thermal conductor 25 in the longitudinal direction thereof also mounts each lateral end of the nip formation pad 23, the outer bracket 40, the support 27, and the halogen heater 26 depicted in FIG. 5A as well as each lateral end plate 28*b* of the reflector 28. The flange restricts movement of the fixing belt 21 in the axial direction thereof.

Alternatively, if the fixing device 20 does not incorporate the thermal conductor 25, the flange mounts each lateral end of the nip formation pad 23, the halogen heater 26, the support 27, the reflector 28, and the outer bracket 40 in the axial direction of the fixing belt 21. Each flange is mounted on a frame or a body of the fixing device 20.

A description is provided of movement of the reflector 28.

As shown in FIG. 7A, by default, a top dead center, that is, the long diameter portion 55*a*, of the cam 55 contacts the lateral end plate 28*b* of the reflector 28. Accordingly, each lateral end plate 28*b* of the reflector 28 is parallel to the halogen heater 26 at the parallel position shown in FIG. 6A.

When a recording medium of frequently used size, for example, an A3 size recording medium in portrait orientation or an A4 size recording medium in landscape orientation, is used as a recording medium P1, the halogen heater 26 heats the recording medium P1 having a width W1 equivalent to a length of the heating portion 26*a* of the halogen heater 26 in the longitudinal direction thereof. That is, the length of the heating portion 26*a* is equivalent to a first heating span S1 of the fixing belt 21 where the recording medium P1 is conveyed. Accordingly, the thermal conductor 25 and the fixing belt 21 are heated substantially evenly in the first heating span S1 thereof equivalent to the width W1 of the recording medium P1 as shown in FIG. 6A with the line indicating the temperature of the fixing belt 21. Consequently, the halogen heater 26 does not heat the thermal conductor 25 and the fixing belt 21 in first outboard spans S1*a* outboard from the first heating span S1 in the axial direction of the fixing belt 21 where the recording medium P1 is not conveyed, thus preventing overheating and resultant breakage of the fixing belt 21 in the first outboard spans S1*a* and insufficient heating of each lateral edge of the recording medium P1 in a width direction thereof parallel to the axial direction of the fixing belt 21 and resultant fixing failure.

Conversely, when a recording medium of infrequently used size, for example, an A3 extension size (329 mm×483 mm) recording medium in portrait orientation, is used as a recording medium P2 that is greater than the recording medium P1 in width, the halogen heater 26 is requested to heat the recording medium P2 having a width W2 greater than the heating portion 26*a* in the longitudinal direction of the halogen heater 26. In this case, the CPU of the image forming apparatus 1 detects the width W2 of the recording medium P2 and actuates the driving assembly 50 based on the detection. For example, the driving assembly 50 rotates each cam 55 such that a bottom dead center, that is, the short diameter portion 55*b*, of each cam 55 contacts each lateral end plate 28*b* of the reflector 28 as shown in FIG. 7B. Accordingly, each lateral end plate 28*b* of the reflector 28 is angled relative to the halogen heater 26 with an increased interval therebetween at the first angled position shown in FIG. 6B.

Since the two cams 55 are mounted on the shaft 54 as shown in FIG. 6A, the two cams 55 start rotating in synchronism. Accordingly, the driving assembly 50 changes the position of both lateral end plates 28*b* of the reflector 28 simultaneously. Since both lateral end plates 28*b* are angled relative to the halogen heater 26 in a direction in which both lateral end plates 28*b* are spaced apart from the halogen heater 26 with an increased interval therebetween, each of the angled lateral end plates 28*b* reflects light from the halogen heater 26 onto the thermal conductor 25 in the first outboard span S1*a* outboard from the first heating span S1 in the axial direction of the fixing belt 21. Thus, the halogen heater 26 heats the recording medium P2 having the width W2 that is greater than the width W1 of the recording medium P1.

For example, a part of light emitted from the halogen heater 26 is reflected by each lateral end plate 28*b* of the reflector 28 and irradiates the thermal conductor 25 in each first outboard span S1*a*, which in turn heats the fixing belt 21 in each first outboard span S1*a*. Thus, the halogen heater 26 heats the thermal conductor 25 and the fixing belt 21 in a second heating span S2 greater than the length of the heating portion 26*a* in the axial direction of the fixing belt 21. Accordingly, the thermal conductor 25 and the fixing belt 21 are heated substantially evenly in the second heating span S2 equivalent to the width W2 of the recording medium P2 as shown in FIG. 6B with the solid line indicating the temperature of the fixing belt 21. Consequently, the halogen heater 26 heats the thermal conductor 25 and the fixing belt 21 in the second heating span S2 sufficiently, thus preventing insufficient heating of each lateral edge of the recording medium P2 in a width direction thereof parallel to the axial direction of the fixing belt 21 and resultant fixing failure.

As described above, the fixing device 20 includes the driving assembly 50 that changes the position of each lateral end plate 28*b* of the reflector 28 between the parallel position shown in FIG. 6A where each lateral end plate 28*b* is parallel to the halogen heater 26 and the first angled position shown in FIG. 6B where each lateral end plate 28*b* is angled relative to the halogen heater 26 in the direction in which each lateral end plate 28*b* is spaced apart from the halogen heater 26 with an increased interval therebetween. Accordingly, at the parallel position, each lateral end plate 28*b* reflects light from the halogen heater 26 onto the thermal conductor 25 in the first heating span S1 thereof corresponding to the width W1 of the recording medium P1. Conversely, at the first angled position, each lateral end plate 28*b* reflects light from the halogen heater 26 onto the thermal conductor 25 in the first outboard span S1*a* thereof outboard from the width W1 of the recording medium P1, thus heating the recording medium P2 having the width W2 greater than the width W1 of the recording medium P1. Consequently, the thermal conductor 25 heats the fixing belt 21 sufficiently even if the recording medium P2 wider than the recording medium P1 is conveyed over the fixing belt 21, thus improving fixing performance. If the reflector 28 is constructed of a single plate, that is, the center plate 28*a*, as the recording medium P2 having the width W2 greater than the heating portion 26*a* of the halogen heater 26 in the longitudinal direction thereof is conveyed over the fixing belt 21, both lateral ends of the recording medium P2 in the width direction thereof may be outboard from the heating portion 26*a* of the halogen heater 26 and therefore may be heated insufficiently. To address this circumstance, the reflector 28 includes the center plate 28*a* and the swingable lateral end plates 28*b*, preventing insufficient heating at both lateral ends of the recording medium P2 and resultant fixing failure.

The single halogen heater 26 heats the recording media of different sizes, that is, the recording media P1 and P2, sufficiently, downsizing the fixing device 20. Additionally, the reflector 28 and the driving assembly 50 have the relatively simple structure, thus simplifying the structure of the fixing device 20.

As shown in FIG. 6A, the reflector 28 incorporated in the fixing device 20 includes the stationary center plate 28*a* and the two lateral end plates 28*b* movable with respect to the halogen heater 26. Alternatively, the reflector 28 may include two reflection plates as shown in FIGS. 8A and 8B.

Figure 8A:
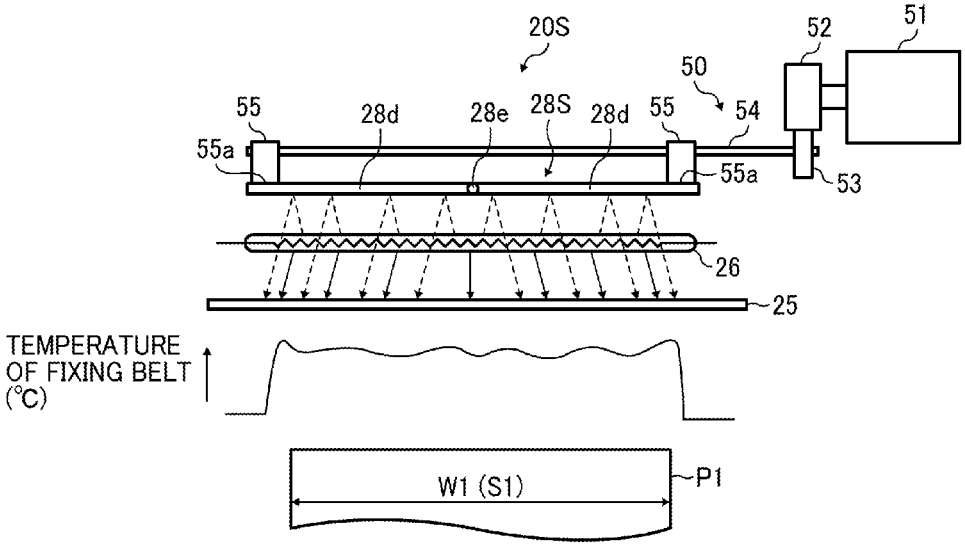
FIG. 8A is a schematic sectional view of a fixing device according to a second example embodiment of the present invention illustrating lateral end plates of a reflector incorporated therein at the parallel position.
Figure 8B:
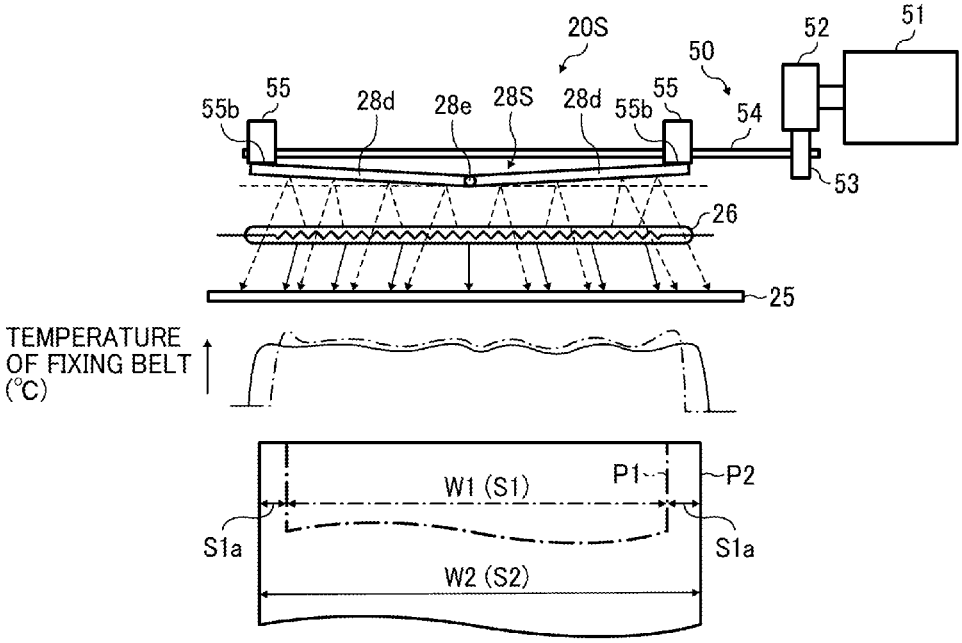
FIG. 8B is a schematic sectional view of the fixing device shown in FIG. 8A illustrating the lateral end plates of the reflector at the first angled position.

With reference to FIGS. 8A and 8B, a description is provided of a configuration of a fixing device 20S incorporating a reflector 28S that includes two lateral end plates 28*d*.

FIG. 8A is a schematic sectional view of the fixing device 20S illustrating the lateral end plates 28*d* parallel to the halogen heater 26. FIG. 8B is a schematic sectional view of the fixing device 20S illustrating the lateral end plates 28*d* angled relative to the halogen heater 26. As shown in FIGS. 8A and 8B, the reflector 28S is divided into the two lateral end plates 28*d* at a substantially center hinge 28*e* interposed between the two lateral end plates 28*d*.

The hinge 28*e* rotatably supports the lateral end plates 28*d* and accommodates a biasing member that biases each lateral end plate 28*d* in a direction in which the lateral end plate 28*d* is spaced apart from the halogen heater 26 with an increased interval therebetween, thus rotating each lateral end plate 28*d* from a parallel position shown in FIG. 8A where the lateral end plate 28*d* is parallel to the halogen heater 26 to a first angled position shown in FIG. 8B where the lateral end plate 28*d* is angled relative to the halogen heater 26 with an increased interval therebetween. That is, the lateral end plate 28*d* is rotatable about the hinge 28*e* disposed opposite a center of the fixing belt 21 in the axial direction thereof. Like the fixing device 20 shown in FIGS. 6A and 6B, the fixing device 20S includes the driving assembly 50 described above.

As shown in FIG. 8A, by default, the top dead center, that is, the long diameter portion 55*a*, of the respective cams 55 contacts the lateral end plate 28*d* of the reflector 28S. Hence, the lateral end plates 28*d* are parallel to the halogen heater 26.

When the recording medium P1 is conveyed over the fixing belt 21, the thermal conductor 25 and the fixing belt 21 are heated substantially evenly throughout the heating span S1 thereof equivalent to the width W1 of the recording medium P1 as shown in FIG. 8A with the line indicating the temperature of the fixing belt 21. Accordingly, the halogen heater 26 does not heat the thermal conductor 25 and the fixing belt 21 in the first outboard spans S1*a* outboard from the first heating span S1 equivalent to the width W1 of the recording medium P1 in the axial direction of the fixing belt 21, thus preventing overheating and resultant breakage of the fixing belt 21 in the first outboard spans S1*a* as well as insufficient heating of each lateral edge of the recording medium P1 in the width direction thereof parallel to the axial direction of the fixing belt 21 and resultant fixing failure.

Conversely, when the recording medium P2 is conveyed over the fixing belt 21, the bottom dead center, that is, the short diameter portion 55*b*, of the respective cams 55 contacts each lateral end plate 28*d* of the reflector 28S as shown in FIG. 8B. Hence, each lateral end plate 28*d* is angled relative to the halogen heater 26 such that the lateral end plate 28*d* is spaced apart from the halogen heater 26 with an increased interval therebetween. For example, a part of light emitted from the halogen heater 26 is reflected by each lateral end plate 28*d* of the reflector 285 and irradiates each first outboard span S1*a* of the thermal conductor 25 outboard from the heating portion 26*a* of the halogen heater 26 in the longitudinal direction thereof. The thermal conductor 25 in turn heats the fixing belt 21 in each first outboard span S1*a*. Accordingly, the thermal conductor 25 and the fixing belt 21 are heated substantially evenly throughout the second heating span S2 equivalent to the width W2 of the recording medium P2 as shown in FIG. 8B with the solid line indicating the temperature of the fixing belt 21. Consequently, the halogen heater 26 heats the thermal conductor 25 and the fixing belt 21 in each first outboard span S1*a* sufficiently, thus preventing insufficient heating of each lateral edge of the recording medium P2 in the width direction thereof parallel to the axial direction of the fixing belt 21 and resultant fixing failure.

As shown in FIGS. 6A and 6B, each lateral end plate 28*b* of the reflector 28 is movable between the parallel position where each lateral end plate 28*b* is parallel to the halogen heater 26 and the first angled position where each lateral end plate 28*b* is angled relative to the halogen heater 26 with an increased interval therebetween. Similarly, as shown in FIGS. 8A and 8B, each lateral end plate 28*d* of the reflector 28S is movable between the parallel position where each lateral end plate 28*d* is parallel to the halogen heater 26 and the first angled position where each lateral end plate 28*d* is angled relative to the halogen heater 26 with an increased interval therebetween. Alternatively, the lateral end plates 28*b* and 28*d* may be movable between three positions, that is, the parallel position where they are parallel to the halogen heater 26, a first angled position where they are spaced apart from the halogen heater 26 with an increased interval therebetween, and a second angled position where they are spaced apart from the halogen heater 26 with a decreased interval therebetween as shown in FIGS. 9A, 9B, and 9C.

Figure 9A:
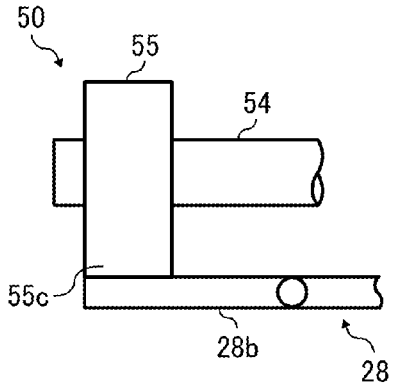
FIG. 9A is a partial sectional view of the lateral end plate and the cam contacting the lateral end plate at the parallel position.
Figure 9B:
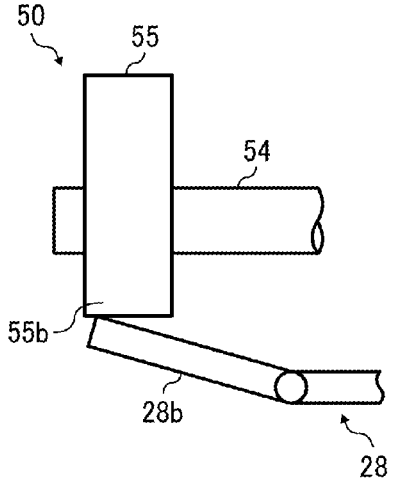
FIG. 9B is a partial sectional view of the lateral end plate and the cam contacting the lateral end plate at the first angled position.
Figure 9C:
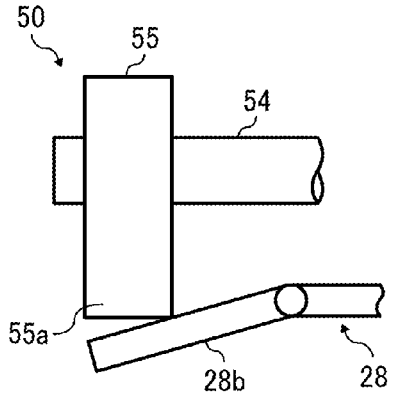
FIG. 9C is a partial sectional view of the lateral end plate and the cam contacting the lateral end plate at a second angled position.

With reference to FIGS. 9A, 9B, and 9C, a description is provided of movement of the lateral end plate 28*b* of the reflector 28 movable between the three positions.

FIG. 9A is a partial sectional view of the reflector 28 and the driving assembly 50 illustrating the lateral end plate 28*b* at the parallel position. FIG. 9B is a partial sectional view of the reflector 28 and the driving assembly 50 illustrating the lateral end plate 28*b* at the first angled position. FIG. 9C is a partial sectional view of the reflector 28 and the driving assembly 50 illustrating the lateral end plate 28*b* at the second angled position. At the parallel position shown in FIG. 9A, the lateral end plate 28*b* is parallel to the halogen heater 26. At the first angled position shown in FIG. 9B, the lateral end plate 28*h* is angled relative to the halogen heater 26 with an increased interval therebetween. At the second angled position shown in FIG. 9C, the lateral end plate 28*b* is angled relative to the halogen heater 26 with a decreased interval therebetween.

Figure 10A:
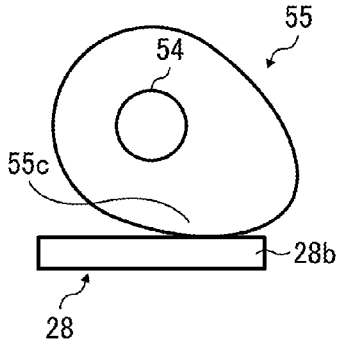
FIG. 10A is a vertical sectional view of the cam and the lateral end plate at the parallel position.
Figure 10B:
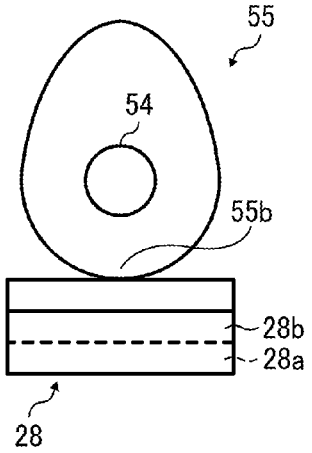
FIG. 10B is a vertical sectional view of the cam and the lateral end plate at the first angled position.
Figure 10C:
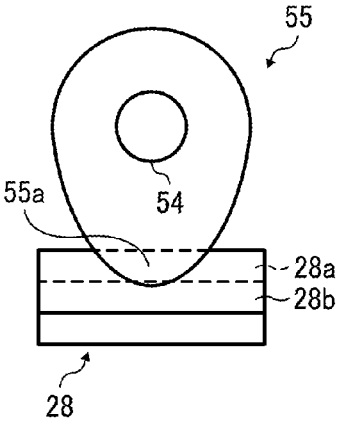
FIG. 10C is a vertical sectional view of the cam and the lateral end plate at the second angled position.

With reference to FIGS. 10A, 10B, and 10C, a description is provided of movement of the cam 55 to move the lateral end plate 28*b* of the reflector 28.

FIG. 10A is a vertical sectional view of the cam 55 and the lateral end plate 28*b* at the parallel position. At the parallel position shown in FIG. 10A where the lateral end plate 28*b* is parallel to the halogen heater 26, a medium diameter portion 55*c* of the cam 55 contacts the lateral end plate 28*b*. FIG. 10B is a vertical sectional view of the cam 55 and the lateral end plate 28*b* at the first angled position. At the first angled position shown in FIG. 10B where the lateral end plate 28*b* is angled relative to the halogen heater 26 with an increased interval therebetween, the short diameter portion 55*b* of the cam 55 contacts the lateral end plate 28*b*. FIG. 10C is a vertical sectional view of the cam 55 and the lateral end plate 28*b* at the second angled position. At the second angled position shown in FIG. 10C where the lateral end plate 28*b* is angled relative to the halogen heater 26 with a decreased interval therebetween, the long diameter portion 55*a* of the cam 55 contacts the lateral end plate 28*b*. With the configuration of the cam 55 shown in FIG. 10C, the lateral end plate 28*b* is closer to the halogen heater 26.

Figure 11A:
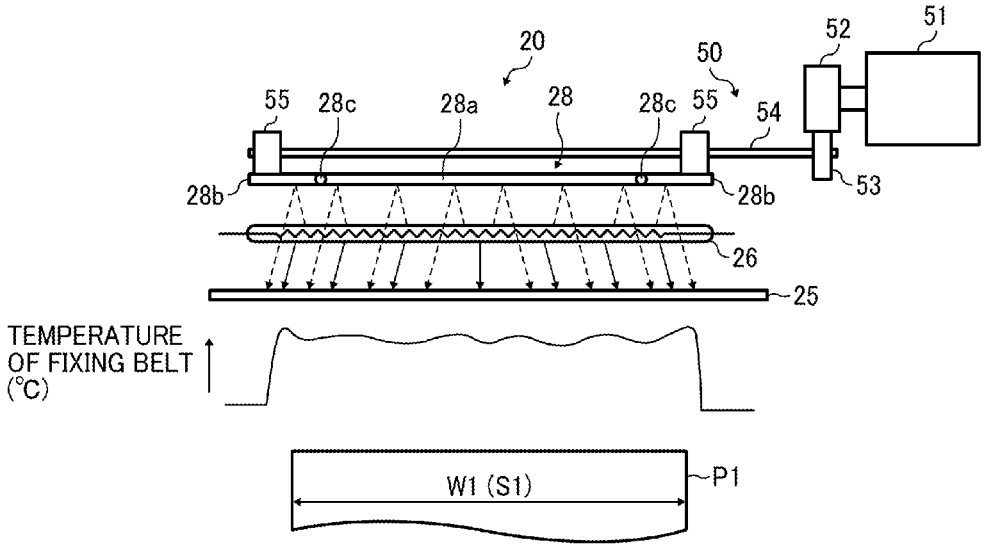
FIG. 11A is a schematic sectional view of the fixing device shown in FIG. 6A illustrating the lateral end plates at the parallel position.
Figure 11B:
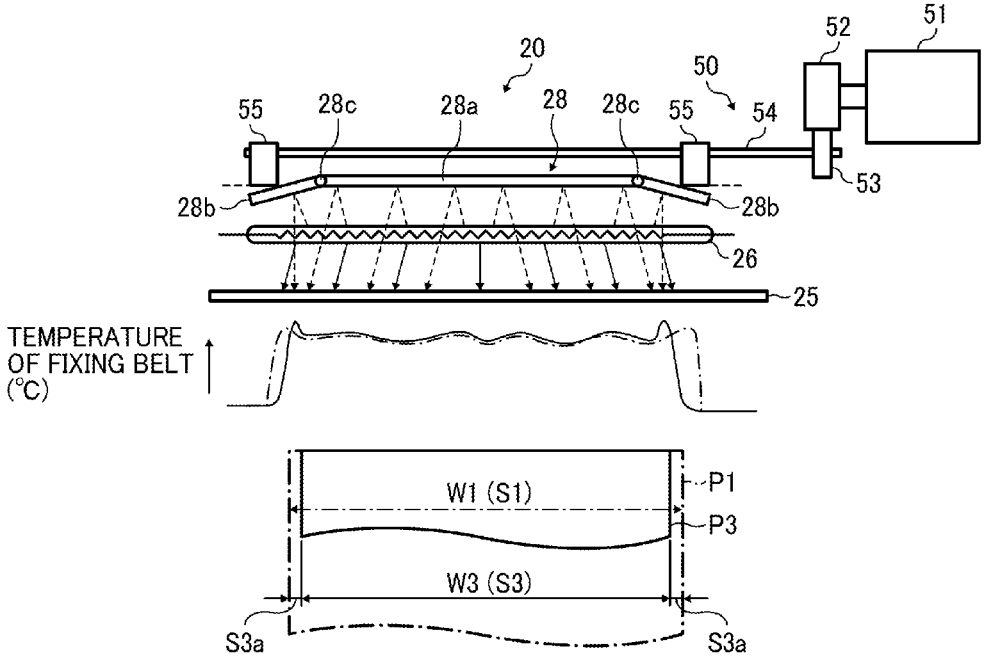
FIG. 11B is a schematic sectional view of the fixing device shown in FIG. 6A illustrating the lateral end plates at the second angled position.

FIG. 11A is a schematic sectional view of the fixing device 20 illustrating the lateral end plates 28*b* at the parallel position. FIG. 11B is a schematic sectional view of the fixing device 20 illustrating the lateral end plates 28*h* at the second angled position. At the second angled position shown in FIG. 11B, the lateral end plates 28*b* reflect light emitted from the halogen heater 26 onto a center third heating span S3 of the thermal conductor 25 spanning in the axial direction of the fixing belt 21. The third heating span S3 is equivalent to a width W3 of a small recording medium P3 that is smaller than the width W1 of the recording medium P1.

When the recording medium P3 having the width W3 smaller than the width W1 of the recording medium P1 that is equivalent to the heating portion 26*a* of the halogen heater 26 is conveyed over the fixing belt 21, the lateral end plates 28*b* are angled relative to the halogen heater 26 at the second angled position where the lateral end plates 28*b* are closer to the halogen heater 26. Accordingly, the lateral end plates 28*b* reflect light emitted from the halogen heater 26 onto the center third heating span S3 of the thermal conductor 25 smaller than the first heating span S1, thus concentrating the light onto the center third heating span S3 of the thermal conductor 25. Consequently, light emitted from the halogen heater 26 irradiates the third heating span S3 of the thermal conductor 25 evenly which is equivalent to the width W3 of the recording medium P3. That is, light emitted from the halogen heater 26 does not irradiate each third outboard span S3*a* outboard from the third heating span S3 in the axial direction of the fixing belt 21. Accordingly, the lateral end plates 28*b* angled at the second angled position suppress overheating and resultant damage of the fixing belt 21 that may be caused by light irradiating the third outboard span S3*a* of the thermal conductor 25 where the recording medium P3 is not conveyed and therefore does not draw heat from the fixing belt 21.

Figure 12A:
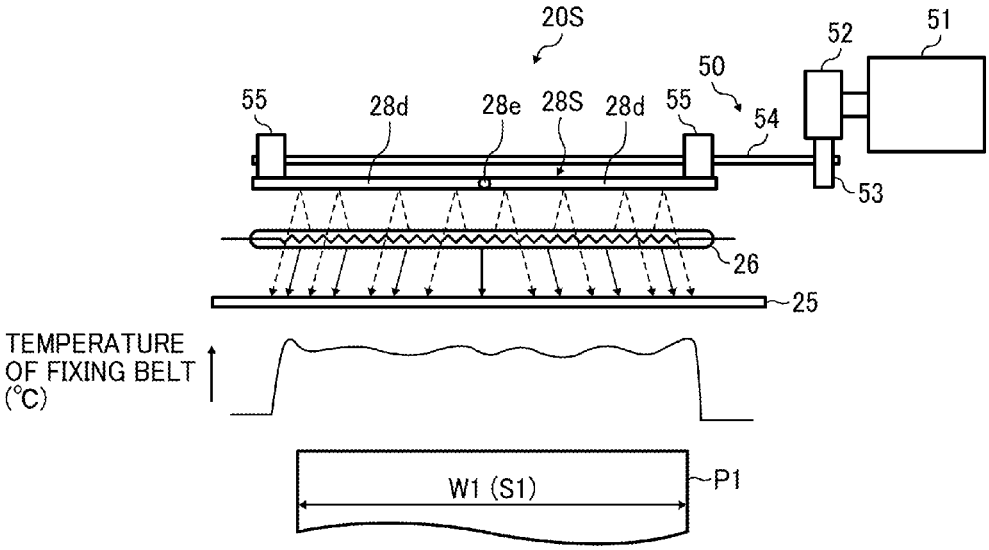
FIG. 12A is a schematic sectional view of the fixing device shown in FIG. 8A illustrating the lateral end plates at the parallel position.
Figure 12B:
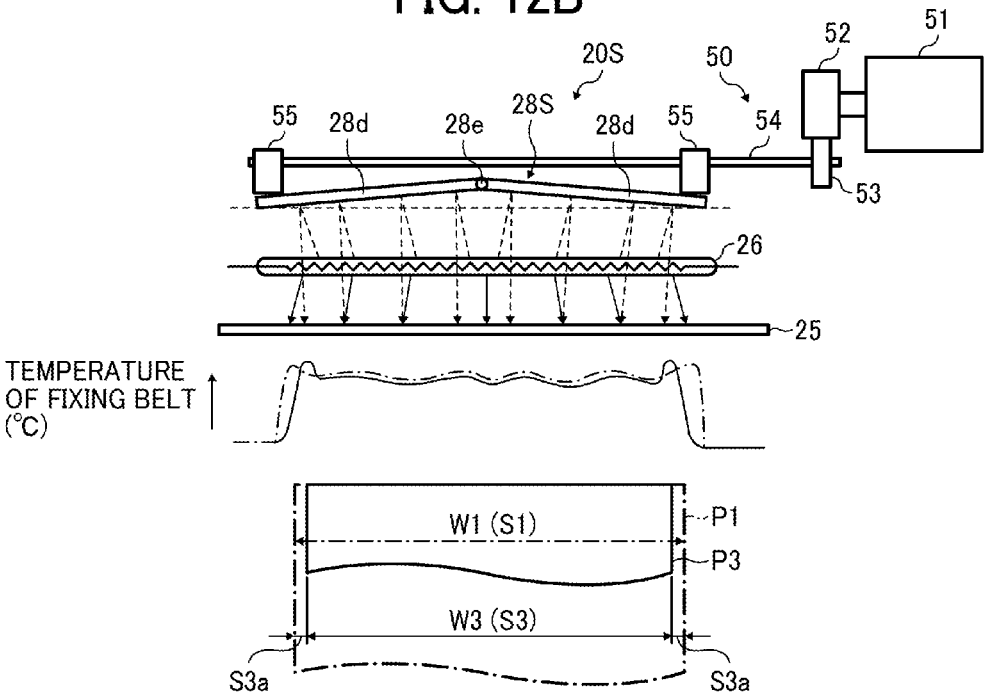
FIG. 12B is a schematic sectional view of the fixing device shown in FIG. 8A illustrating the lateral end plates at the second angled position.

It is to be noted that the lateral end plates 28*d* depicted in FIGS. 8A and 8B are also movable between the parallel position, the first angled position, and the second angled position as shown in FIGS. 12A and 12B. FIG. 12A is a schematic sectional view of the fixing device 20S illustrating the lateral end plates 28*d* at the parallel position. FIG. 12B is a schematic sectional view of the fixing device 20S illustrating the lateral end plates 28*d* at the second angled position. At the parallel position shown in FIG. 12A, the lateral end plates 28*d* of the reflector 28S are parallel to the halogen heater 26. Conversely, at the second angled position, the lateral end plates 28*d* of the reflector 28S are angled relative to the halogen heater 26 with a decreased interval therebetween.

Figure 13:
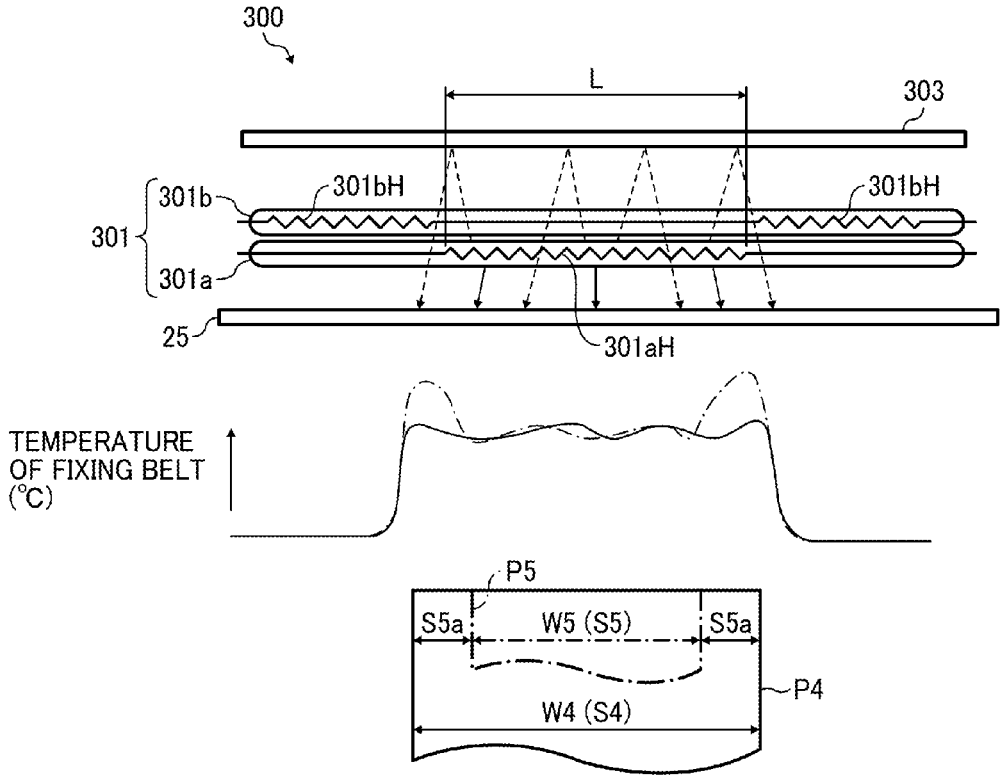
FIG. 13 is a schematic sectional view of a fixing device according to a third example embodiment of the present invention incorporating a plurality of heaters.

The fixing device 20 shown in FIGS. 6A, 6B, 11A, and 11B and the fixing device 20S shown in FIGS. 8A and 8B incorporate the single halogen heater 26. Alternatively, a fixing device may incorporate two halogen heaters as shown in FIG. 13. FIG. 13 is a schematic sectional view of a fixing device 300 incorporating a halogen heater pair 301 including two halogen heaters. As shown in FIG. 13, the halogen heater pair 301 includes a center heater 301*a* having a center heating portion 301*a*H at a center in a longitudinal direction thereof parallel to the axial direction of the fixing belt 21 and a lateral end heater 301*b* having lateral end heating portions 301*b*H at both lateral ends in a longitudinal direction thereof parallel to the axial direction of the fixing belt 21. The fixing device 300 further includes a reflector 303 constructed of a single plate.

A length L of the center heating portion 301*a*H of the center heater 301*a* is equivalent to a width W4 of a recording medium P4 smaller than the width W1 of the recording medium P1, for example, an A4 size recording medium in portrait orientation frequently used. Accordingly, the center heating portion 301*a*H heats the thermal conductor 25 in a fourth heating span S4 equivalent to the width W4 of the recording medium P4. When a recording medium P5 having a width W5 (e.g., a postcard infrequently used) smaller than the width W4 of the recording medium P4 is conveyed over the fixing belt 21, even if the center heater 301*a* is used, the center heater 301*a* heats the thermal conductor 25 in fifth outboard spans S5*a* outboard from a fifth heating span S5 equivalent to the width W5 of the recording medium P5 in the axial direction of the fixing belt 21. In the fifth outboard spans S5*a*, the recording medium P5 is not conveyed and therefore does not draw heat from the fixing belt 21. Accordingly, the fixing belt 21 overheats in the fifth outboard spans S5*a* as indicated by the alternate long and short dashed lines in FIG. 13 showing the temperature of the fixing belt 21. Consequently, the fixing belt 21 may be thermally damaged.

To address this circumstance, the fixing device 300 may include the reflector 28S shown in FIGS. 8A, 8B, 12A, and 12B that includes the movable lateral end plates 28*d* instead of the reflector 303. As the lateral end plates 28*d* are angled relative to the halogen heater pair 301 at the second angled position shown in FIG. 12B, even if the center heater 301*a* is used, the lateral end plates 28*d* reflect light emitted from the center heater 301*a* onto the fifth heating span S5 of the thermal conductor 25 that is equivalent to the width W5 of the recording medium P5. Accordingly, the light reflected by the lateral end plates 28*d* is concentrated on the fifth heating span S5 of the thermal conductor 25 that is smaller than the length L of the center heating portion 301*a*H of the center heater 301*a*, thus heating the thermal conductor 25 in the fifth heating span S5. That is, the fifth outboard spans S5*a* of the thermal conductor 25 that are outboard from the fifth heating span S5 equivalent to the width W5 of the recording medium P5 in the axial direction of the fixing belt 21 are barely heated by the center heater 301*a*. Consequently, the fixing belt 21 is not heated in the fifth outboard spans S5*a* where the recording medium P5 is not conveyed and therefore does not draw heat from the fixing belt 21, suppressing overheating and resultant damage of the fixing belt 21.

A description is provided of a configuration of the driving assembly 50.

According to the example embodiments described above, a stepping motor is used as the driver 51 of the driving assembly 50. Alternatively, a direct current (DC) motor may be used as the driver 51. Additionally, the CPU may control the driver 51 by feedback based on a detection result sent from a location sensor for detecting the position of the cams 55 or the lateral end plates 28*b* and 28*d*.

Yet alternatively, instead of the driver 51, an operating member (e.g., a lever and a knob) for rotating the shaft 54 may be connected to the shaft 54. For example, as the user rotates the operating member manually, the operating member rotates the shaft 54 to change the angle of the lateral end plates 28*b* or 28*d*. In this case, the driver 51 is removed, simplifying the structure and control for moving the lateral end plates 28*b* and 28*d*. For example, for the user who uses recording media of a particular size, the operating member manually actuated by the user is advantageous in view of manufacturing costs.

Conversely, for the user who uses recording media of various sizes, the driver 51 automatically driving and moving the lateral end plates 28*b* or 28*d* is advantageous in view of operating efficiency.

Figure 14:
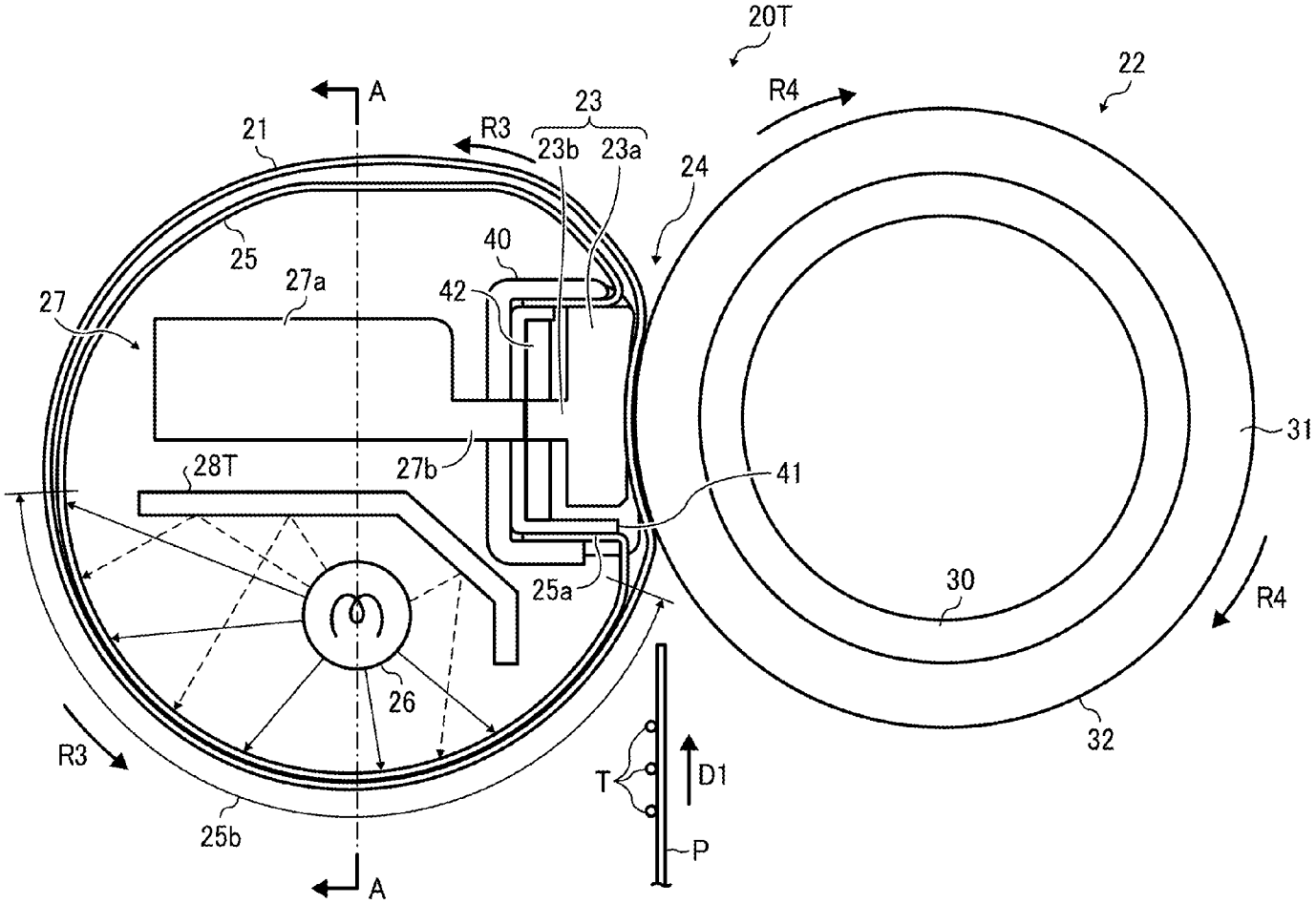
FIG. 14 is a vertical sectional view of a fixing device according to a fourth example embodiment of the present invention incorporating a polygonal reflector as one variation.
Figure 15:
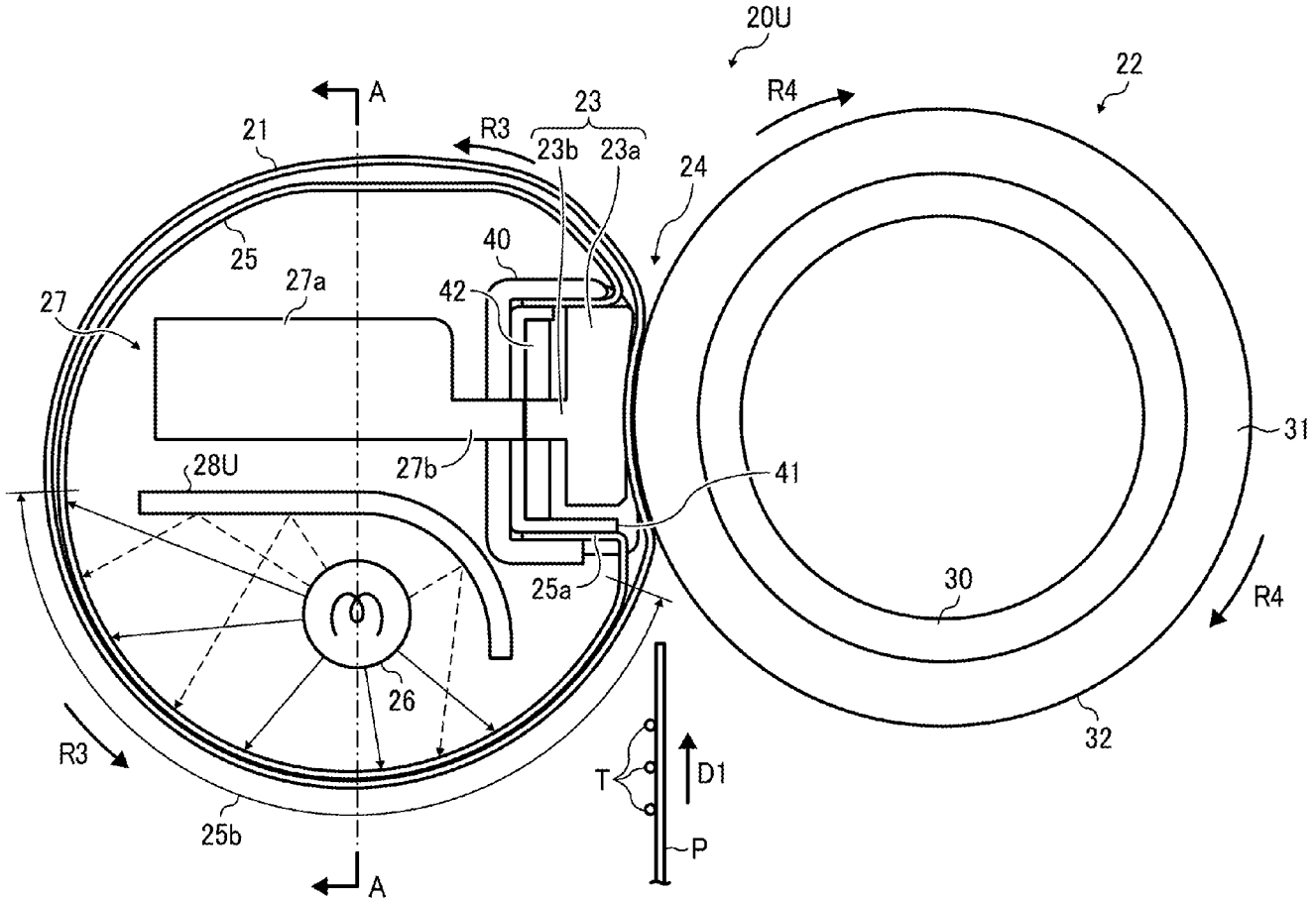
FIG. 15 is a vertical sectional view of a fixing device according to a fifth example embodiment of the present invention incorporating an arcuate reflector as another variation.

According to the example embodiments described above, the reflectors 28 and 28S have a planar plate shape. Alternatively, reflectors of various shapes may be used as shown in FIGS. 14 and 15. FIG. 14 is a vertical sectional view of a fixing device 20T incorporating a polygonal reflector 28T as one variation. FIG. 15 is a vertical sectional view of a fixing device 20U incorporating an arcuate reflector 28U as another variation. As shown in FIG. 14, the reflector 28T has a polygonal shape in cross-section and includes the lateral end plates 28*b* or 28*d* described above. As shown in FIG. 15, the reflector 28U is arc-shaped in cross-section and includes the lateral end plates 28*h* or 28*d* described above.

Figure 16A:
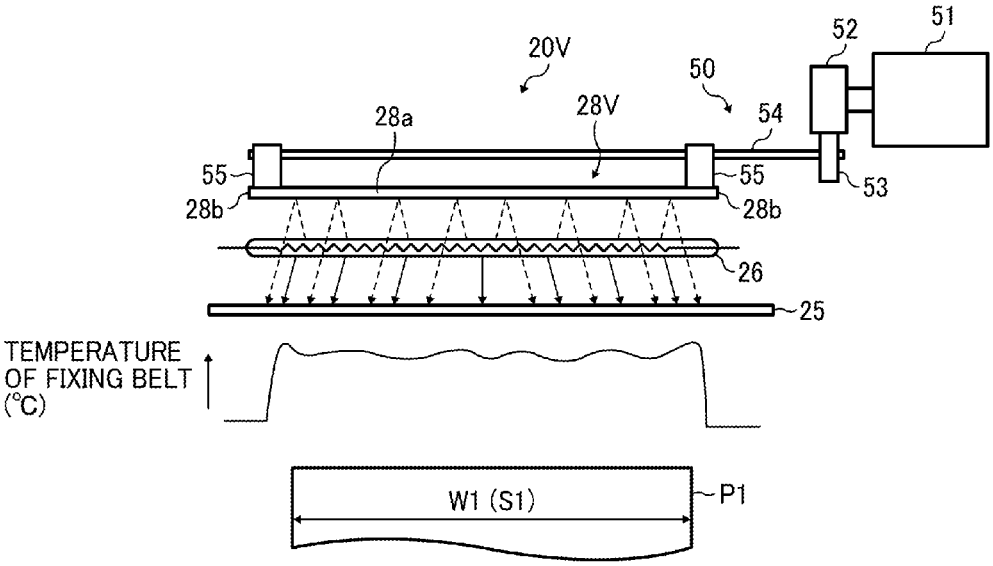
FIG. 16A is a schematic sectional view of a fixing device according to a sixth example embodiment of the present invention incorporating a reflector with no hinge, illustrating the lateral end plates at the parallel position.
Figure 16B:
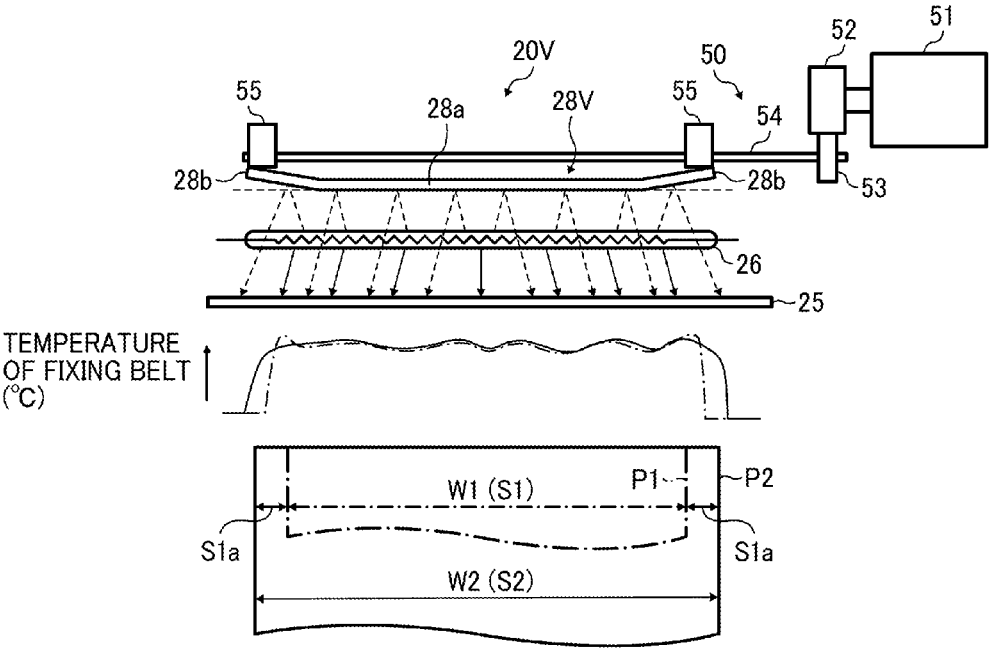
FIG. 16B is a schematic sectional view of the fixing device shown in FIG. 16A illustrating the lateral end plates at the first angled position.

According to the example embodiments described above, the reflectors 28 and 28S incorporate the hinges 28*c* and 28*e* that move the lateral end plates 28*b* and 28*d*, respectively. Alternatively, a reflector may not incorporate the hinges 28*c* and 28*e* as shown in FIGS. 16A and 16B. FIG. 16A is a schematic sectional view of a fixing device 20V incorporating a reflector 28V with no hinge illustrating the lateral end plates 28*b* at the parallel position. FIG. 16B is a schematic sectional view of the fixing device 20V illustrating the lateral end plates 28*b* at the first angled position. As shown in FIG. 16B, the lateral end plates 28*b* of the reflector 28V are made of a flexible material deformable or bendable by the cams 55. Accordingly, the lateral end plates 28*b* are moved between the parallel position shown in FIG. 16A where they are parallel to the halogen heater 26 and the first angled position shown in FIG. 16B where they are angled relative to the halogen heater 26 with an increased interval therebetween.

A description is provided of a configuration of the flanges that support the lateral end plates 28*b* and 28*d* of the reflectors 28 and 28S and both lateral ends of the halogen heater 26 in the longitudinal direction thereof, respectively.

If a part of each lateral end plate 28*b* of the reflector 28 is supported by the flange, each lateral end plate 28*b* is coupled to the flange through a through-hole produced therein and a spring anchored to the flange. In this case, as each lateral end plate 28*b* rotates about the hinge 28*c* in accordance with rotation of the cam 55, the center plate 28*a* may move closer to or away from the halogen heater 26. Accordingly, each lateral end plate 28*b* is supported by the flange such that it is movable in the axial direction of the fixing belt 21 relative to the flange.

According to the example embodiments described above, the cams 55 are in proximity to and in contact with both lateral end plates 28*b* or 28*d* to vertically press both lateral end plates 28*b* or 28*d*, respectively. Alternatively, the cams 55 may contact both lateral end plates 28*b* or 28*d* at positions shifted from the positions shown in FIGS. 6A and 8A in the axial direction of the fixing belt 21. Further, two or more cams 55 may be in contact with each lateral end plate 28*b* or 28*d*.

As shown in FIGS. 5A, 8A, 13, 14, 15, and 16A, a fixing device (e.g., the fixing devices 20, 20S, 300, 20T, 20U, and 20V) includes a fixing rotary body, that is, a flexible, endless fixing belt 21 formed into a loop and rotatable in the rotation direction R3; a nip formation pad (e.g., the nip formation pad 23) disposed inside the fixing rotary body; a pressing rotary body (e.g., the pressing roller 22) disposed outside the fixing rotary body and pressed against the nip formation pad via the fixing rotary body to form the fixing nip 24 between the pressing rotary body and the fixing rotary body through which a recording medium bearing a toner image is conveyed; a tubular thermal conductor (e.g., the thermal conductor 25) disposed opposite the inner circumferential surface of the fixing rotary body to rotatably support the fixing rotary body; a heater (e.g., the halogen heater 26), extending in the axial direction of the fixing rotary body, disposed opposite and heating at least the thermal conducting portion 25*b* of the thermal conductor where the thermal conductor heats the fixing rotary body; and a reflector (e.g., the reflectors 28, 28S, 28T, 28U, and 28V) disposed opposite the thermal conducting portion 25*b* of the thermal conductor via the heater to reflect light emitted from the heater onto the thermal conducting portion 25*b* of the thermal conductor. At least a part of the reflector is movable to change the reflection direction in which the reflector reflects the light emitted from the heater onto the thermal conductor. For example, the reflector includes a movable portion (e.g., the lateral end plates 28*b* and 28*d*) movable relative to the heater to direct the light emitted from the heater onto a variable heating span (e.g., the first to fifth heating spans S1, S2, S3, S4, and S5) of the fixing rotary body spanning in an axial direction thereof. The variable heating span varies depending on a width of the recording medium in the axial direction of the fixing rotary body.

Accordingly, even without increasing the number of the heaters, the reflector reflects and directs light emitted from the heater to the variable heating span of the thermal conductor and the fixing rotary body which varies depending on the width of recording media, thus preventing overheating of the fixing rotary body in an outboard span outboard from the variable heating span in the axial direction of the fixing rotary body and therefore suppressing breakage of the fixing rotary body and fixing failure.

According to the example embodiments described above, the recording medium conveyed over the fixing belt 21 is centered in the axial direction thereof. Alternatively, the recording medium may be conveyed along one edge of the fixing belt 21 in the axial direction thereof. In this case, the reflectors 28, 28S, 28T, 28U, and 28V may include the single lateral end plate 28*b* or 28*d* disposed opposite one lateral end of the fixing belt 21 in the axial direction thereof.

According to the example embodiments described above, the fixing belt 21 serves as a fixing rotary body. Alternatively, a fixing roller or the like may serve as a fixing rotary body. Further, the pressing roller 22 serves as a pressing rotary body. Alternatively, a pressing belt or the like may serve as a pressing rotary body.

Additionally, according to the example embodiments described above, the thermal conductor 25 is disposed opposite the inner circumferential surface of the fixing belt 21. Alternatively, the thermal conductor 25 may be eliminated. In this case also, the reflectors 28, 28S, 28T, 28U, and 28V may be disposed inside a fixing rotary body (e.g., the fixing belt 21 and a fixing roller) to reflect light emitted from the heater 26 onto an inner circumferential surface of the fixing rotary body.

The present invention has been described above with reference to specific example embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative example embodiments may be combined with each other and/or substituted for each other within the scope of the present invention.

What is claimed is:

1. A fixing device comprising:

a fixing rotary body rotatable in a given direction of rotation;

a pressing rotary body pressed against the fixing rotary body to form a fixing nip therebetween through which a recording medium bearing a toner image is conveyed;

a heater disposed inside the fixing rotary body to heat the fixing rotary body; and a reflector, disposed opposite an inner circumferential surface of the fixing rotary body via the heater, to reflect light emitted from the heater onto the fixing rotary body, the reflector including:

a movable portion movable relative to the heater to direct the light emitted from the heater onto a variable heating span of the fixing rotary body spanning in an axial direction thereof, the variable heating span varying depending on a width of the recording medium in the axial direction of the fixing rotary body, wherein the movable portion of the reflector is movable between a parallel position where the movable portion is parallel to the heater and a first angled position where the movable portion is angled relative to the heater with an increased interval therebetween, and wherein the movable portion of the reflector is movable further to a second angled position where the movable portion is angled relative to the heater with a decreased interval therebetween.

2. The fixing device according to claim 1, further comprising a rotatable cam including:

a long diameter portion to come into contact with the movable portion of the reflector to move the movable portion to the parallel position; and a short diameter portion to come into contact with the movable portion of the reflector to move the movable portion to the first angled position.

3. The fixing device according to claim 1, further comprising a rotatable cam including:

a long diameter portion to come into contact with the movable portion of the reflector to move the movable portion to the second angled position;

a short diameter portion to come into contact with the movable portion of the reflector to move the movable portion to the first angled position; and a medium diameter portion to come into contact with the movable portion of the reflector to move the movable portion to the parallel position.

4. The fixing device according to claim 1, wherein the movable portion of the reflector is movable between a parallel position where the movable portion is parallel to the heater and a second angled position where the movable portion is angled relative to the heater with a decreased interval therebetween.

5. The fixing device according to claim 1, wherein the movable portion of the reflector includes a lateral end plate disposed opposite a lateral end of the fixing rotary body in the axial direction thereof.

6. The fixing device according to claim 5, wherein the reflector further includes a hinge rotatably mounting the lateral end plate.

7. The fixing device according to claim 6, wherein the reflector further includes a stationary portion coupled and adjacent to the lateral end plate through the hinge in the axial direction of the fixing rotary body.

8. The fixing device according to claim 7, wherein the stationary portion of the reflector includes a center plate and the heater includes a heating portion disposed opposite the center plate of the reflector spanning in the axial direction of the fixing rotary body.

9. The fixing device according to claim 8, wherein the lateral end plate is partially disposed opposite the heating portion of the heater.

10. The fixing device according to claim 1, further comprising a driving assembly contacting and moving the movable portion of the reflector.

11. The fixing device according to claim 10, wherein the movable portion of the reflector includes a plurality of lateral end plates disposed opposite both lateral ends of the fixing rotary body in the axial direction thereof, respectively.

12. The fixing device according to claim 11, wherein the driving assembly moves the plurality of lateral end plates simultaneously.

13. The fixing device according to claim 1, wherein the movable portion of the reflector is moved manually.

14. The fixing device according to claim 1, wherein the reflector is polygonal in cross-section.

15. The fixing device according to claim 1, wherein the reflector is arc-shaped in cross-section.

16. The fixing device according to claim 1, wherein the reflector is flexible and bendable.

17. The fixing device according to claim 1, further comprising a thermal conductor disposed opposite the inner circumferential surface of the fixing rotary body to conduct heat received from the heater to the fixing rotary body.

18. An image forming apparatus comprising the fixing device according to claim 1.

19. A fixing device comprising:

a fixing rotary body rotatable in a given direction of rotation;

a pressing rotary body pressed against the fixing rotary body to form a fixing nip therebetween through which a recording medium bearing a toner image is conveyed;

a heater disposed inside the fixing rotary body to heat the fixing rotary body; and a reflector, disposed opposite an inner circumferential surface of the fixing rotary body via the heater, to reflect light emitted from the heater onto the fixing rotary body, the reflector including:

a movable portion movable relative to the heater to direct the light emitted from the heater onto a variable heating span of the fixing rotary body spanning in an axial direction thereof, the variable heating span varying depending on a width of the recording medium in the axial direction of the fixing rotary body, wherein the movable portion of the reflector is movable between a parallel position where the movable portion is parallel to the heater and a first angled position where the movable portion is angled relative to the heater with an increased interval therebetween;

a support and a nip formation pad supported by the support, wherein the reflector is spaced apart from the support.

* * * * *